US009554655B2

(12) United States Patent
Abadi

(10) Patent No.: US 9,554,655 B2
(45) Date of Patent: Jan. 31, 2017

(54) SUPPORT SURFACE ASSEMBLY AND TENSIONING METHOD FOR A SLEEPING PERSON

(75) Inventor: Shlomo Abadi, Pardes-Hana (IL)

(73) Assignee: AIRNETTRESS LTD, Tel Aviv (IL)

( * ) Notice: Subject to any disclaimer, the term of this patent is extended or adjusted under 35 U.S.C. 154(b) by 230 days.

(21) Appl. No.: 13/980,674

(22) PCT Filed: Aug. 30, 2012

(86) PCT No.: PCT/IL2012/050015
§ 371 (c)(1),
(2), (4) Date: Jul. 19, 2013

(87) PCT Pub. No.: WO2012/114336
PCT Pub. Date: Aug. 30, 2012

(65) Prior Publication Data

US 2013/0298335 A1 Nov. 14, 2013

Related U.S. Application Data

(63) Continuation-in-part of application No. 13/009,871, filed on Jan. 20, 2011, now Pat. No. 8,769,746.

(51) Int. Cl.
*A47C 21/04* (2006.01)
*A47C 23/24* (2006.01)
(Continued)

(52) U.S. Cl.
CPC ..... *A47C 21/046* (2013.01); *A47C 23/24* (2013.01); *A47C 23/28* (2013.01); *A47C 27/007* (2013.01);
(Continued)

(58) Field of Classification Search
CPC ..... A47C 21/046; A47C 31/007; A47C 23/24; A47C 27/007; A47C 23/28; A47C 31/105; A47C 23/18; A47C 23/20; A47C 23/26; A47C 23/30; A47D 15/001; A47D 7/00; A47D 9/00
See application file for complete search history.

(56) References Cited

U.S. PATENT DOCUMENTS 128,504 A * 7/1872 Peters ..... A47C 17/64 5/196
286,866 A * 10/1883 Thatcher ..... A47C 23/28 5/213
(Continued)

FOREIGN PATENT DOCUMENTS

AU 642603 3/1993
DE 339421 7/1921
(Continued)

OTHER PUBLICATIONS

International Search Report, Application No. PCT/IL2007/000976 Aug. 27, 2008. (3 pages).
(Continued)

*Primary Examiner* — Nicholas Polito
*Assistant Examiner* — Eric Kurilla
(74) *Attorney, Agent, or Firm* — Dorsey & Whitney LLP

(57) ABSTRACT

A kit (100) for constructing a support surface (10) for a sleeping person. The kit (100) comprises: an air-permeable layer (20) having at least one pair of opposing layer-edge portions stretchable at least in the direction between the layer-edge portions (11, 12, 13, 14) to form the support surface; at least one pair of parallel opposing frame sections (30, 32, 34, 36) fixedly disposable at a distance therebetween for forming at least a portion of a frame (15) supporting the support surface; at least a first of said frame sections (30, 32, 34, 36) comprising a layer-edge engaging portion (31, 33, 35, 37) configured for fixedly engaging a corresponding layer-edge portion (11, 12, 13, 14); and a tensioning mechanism configured for moving the layer-edge engaging portion
(Continued)

(31, 33, 35, 37) together with the layer-edge portion (11, 12, 13, 14) relative to the opposing frame section (30, 32, 34, 36) to at least partially tension the air-permeable layer (20) between the frame sections (30, 32, 34, 36).

13 Claims, 24 Drawing Sheets

(51) Int. Cl.

| | |
|---|---|
| ***A47C 23/28*** | (2006.01) |
| ***A47C 27/00*** | (2006.01) |
| ***A47C 31/00*** | (2006.01) |
| ***A47C 31/10*** | (2006.01) |
| ***A47D 7/00*** | (2006.01) |
| ***A47D 9/00*** | (2006.01) |
| ***A47D 15/00*** | (2006.01) |

(52) U.S. Cl.
CPC ..... *A47C 31/007* (2013.01); *A47C 31/105* (2013.01); *A47D 7/00* (2013.01); *A47D 9/00* (2013.01); *A47D 15/001* (2013.01); *Y10T 29/49826* (2015.01); *Y10T 29/53* (2015.01)

(56) References Cited

U.S. PATENT DOCUMENTS

| | | | | | |
|---|---|---|---|---|---|
| 663,692 | A | | 12/1900 | Brand | |
| 952,730 | A | * | 3/1910 | Elliott | A47C 23/28 5/216 |
| 984,391 | A | * | 2/1911 | Pruitt | A47C 23/28 5/196 |
| 1,096,710 | A | * | 5/1914 | Gilmour | A47C 23/28 5/211 |
| 1,173,744 | A | | 2/1916 | Rukes | |
| 1,319,658 | A | | 10/1919 | Schulte | |
| 1,425,719 | A | * | 8/1922 | Swan | A47C 23/28 5/190 |
| 1,748,010 | A | | 2/1930 | Rusha et al. | |
| 1,748,018 | A | * | 2/1930 | Goodwill | A47C 23/28 5/201 |
| 1,944,064 | A | | 1/1934 | Byer | |
| 2,600,240 | A | | 6/1952 | Grieb | |
| 2,630,587 | A | * | 3/1953 | Brown | A47C 21/022 5/496 |
| 2,787,794 | A | * | 4/1957 | Hughes | A47C 27/007 5/496 |
| 3,012,362 | A | * | 12/1961 | Blinderman | A47C 17/66 160/374.1 |
| 3,076,451 | A | | 2/1963 | Stoner | |
| 3,289,220 | A | * | 12/1966 | Grimshaw | A47C 7/20 101/127.1 |
| 3,335,713 | A | | 8/1967 | Grosholz et al. | |
| 3,337,881 | A | * | 8/1967 | Schilte | A47C 19/04 5/202 |
| 3,546,721 | A | * | 12/1970 | Cleary | A47C 29/003 135/115 |
| 3,651,854 | A | * | 3/1972 | Terna | B44D 3/185 160/374.1 |
| 4,146,885 | A | | 3/1979 | Lawson, Jr. | |
| 4,565,020 | A | * | 1/1986 | Beatriz | B44D 3/185 160/374.1 |
| 4,657,025 | A | | 4/1987 | Orlando | |
| 4,657,026 | A | | 4/1987 | Tagg | |
| 4,730,356 | A | * | 3/1988 | Suzuki | A47C 23/28 5/187 |
| 4,730,604 | A | | 3/1988 | Boggs | |
| 5,317,767 | A | | 6/1994 | Hargest et al. | |
| 5,360,258 | A | | 11/1994 | Alivizatos | |
| 5,396,674 | A | | 3/1995 | Bolds | |
| 5,561,876 | A | | 10/1996 | Petruzella | |
| 5,566,407 | A | * | 10/1996 | Lien | A47D 7/00 5/186.1 |
| 5,664,273 | A | | 9/1997 | Obriot | |
| 5,699,571 | A | * | 12/1997 | Yowell | A47C 21/046 5/652.1 |
| 5,855,031 | A | | 1/1999 | Swift, Jr. | |
| 5,857,232 | A | | 1/1999 | Mahdavi | |
| 5,887,304 | A | | 3/1999 | Von de Heyde | |
| 5,992,348 | A | * | 11/1999 | Harding | A47C 23/26 119/28.5 |
| 6,026,525 | A | | 2/2000 | Davis | |
| 6,074,340 | A | | 6/2000 | Sweeney et al. | |
| 6,131,216 | A | | 10/2000 | Pine | |
| 6,199,234 | B1 | | 3/2001 | Srour et al. | |
| 6,256,813 | B1 | | 7/2001 | Aaron | |
| 6,336,237 | B1 | | 1/2002 | Schmid | |
| 6,511,562 | B1 | * | 1/2003 | Coffield | A47C 4/30 156/196 |
| 6,513,178 | B1 | | 2/2003 | Kelly et al. | |
| 7,127,763 | B1 | * | 10/2006 | Schmid | A47C 21/044 5/423 |
| 2003/0070232 | A1 | | 4/2003 | Diak/Ghanem | |
| 2003/0163870 | A1 | * | 9/2003 | Porter | A47C 27/006 5/490 |
| 2004/0261174 | A1 | | 12/2004 | DeHart et al. | |
| 2006/0000020 | A1 | * | 1/2006 | Matheus | A47C 17/64 5/110 |
| 2007/0011813 | A1 | | 1/2007 | Rathle | |
| 2009/0151070 | A1 | * | 6/2009 | Bengtsson | A47C 17/80 5/118 |
| 2009/0188048 | A1 | * | 7/2009 | Shlomo | A47C 21/046 5/691 |
| 2009/0211022 | A1 | | 8/2009 | Harding | |
| 2009/0241264 | A1 | | 10/2009 | Bensoussan | |
| 2010/0275379 | A1 | | 11/2010 | Streightiff | |

FOREIGN PATENT DOCUMENTS

| | | |
|---|---|---|
| EP | 0852472 | 7/1998 |
| GB | 190914449 | 0/1910 |
| GB | 1501281 | 2/1978 |
| GB | 1579867 | 11/1980 |
| GB | 2095541 | 10/1982 |
| GB | 2264050 | 8/1993 |
| GB | 2320182 | 6/1998 |
| JP | 11076324 | 3/1990 |
| JP | H10248679 | 9/1998 |
| JP | 2006263092 | 10/2006 |
| WO | WO0143597 | 6/2001 |
| WO | WO2006108540 | 10/2006 |

OTHER PUBLICATIONS

Merriam Webster definition of the word fabric) (1 page) (available as of Aug. 12, 2011).
Merriam Webster definition of the word "mesh" (1 page) (available as of Aug. 12, 2011).
International Search Report from International Application No. PCT/IL2012/050015 mailed Jun. 19, 2012.

* cited by examiner

| Mattress | Exposure (days) | Estimated No.mites | No. living mites | Average |
|---|---|---|---|---|
| I | 2 | (+) | | |
| J | 2 | + | | |
| K | 2 | (+) | | |
| Control (C) | 2 | ++ | | |
| I | 4 | (+) | | |
| J | 4 | (+) | | |
| K | 4 | (+) | | |
| Control (C) | 4 | ++ | | |
| I | 7 | | 20 | |
| J | 7 | | 27 | 26.3 |
| K | 7 | | 32 | |
| Control (C) | 7 | | 490 | |

SUPPORT SURFACE ASSEMBLY AND TENSIONING METHOD FOR A SLEEPING PERSON

TECHNICAL FIELD

The present invention relates in general to the field of sleeping surfaces. In particular, the present invention relates to a support surface assembly for sleeping persons. More particularly, the present invention relates to an air-permeable support surface assembly to allow a person to breath naturally and without obstruction while sleeping thereon and to a method for tensioning the surface.

BACKGROUND DESCRIPTION

Sleep is considered to be a time of growth and rejuvenation for organisms. Teenagers and adults typically sleep between 6-8 hours per night, while children and the elderly often require more sleep and thus spend more time in bed. It is therefore important that the surface that one sleeps on, no matter what one's age, does not pose any risks for any health or physical harm.

One of the many aspects of infant care includes the position in which an infant should sleep. Based on current research, parents are advised to place a sleeping infant in a supine (face-up) position, as opposed to a prone (face-down) position, due to the possible risks involved with prone sleeping. These risks include suffocation, which may occur if air (oxygen) flow to the infant is obstructed. Such an incident is more likely when the infant is positioned in a manner wherein its mouth and nose are in close contact with or are enveloped by a soft mattress or a mattress cover. Similarly, in a prone position, the infant may breathe into a small unventilated space, so that it may inhale exhaled carbon dioxide for an extended period of time, which in a subset of infants can lead to asphyxiation and death.

Although the sleeping infant may be positioned in its crib or bed in a supine position, when the infant is strong enough to turn over by itself, it may change on its own to a prone position. In many cases, an infant may be strong enough to turn from a supine to prone position, but not the reverse. Thus, if an adult does not notice that the infant has turned over, the infant may remain in the prone position for an entire night.

It is therefore important that the surface upon which an infant sleeps is air-permeable to allow the infant to breathe naturally and fully without obstruction, even in a prone position.

The American Academy of Pediatrics [www.aap.org] discloses that a firm mattress is helpful in preventing sudden infant death syndrome (SIDS) and in promoting child development. There have been various attempts by the prior art to overcome to problems associated with sleeping infants; however, they each have drawbacks or difficulties of their own.

For example, U.S. Pat. No. 5,664,273 and U.S. Pat. No. 6,026,525 disclose different mattress assemblies for supporting a sleeping infant or child.

SUMMARY OF THE PRESENTLY DISCLOSED SUBJECT MATTER

The present invention relates to a support surface assembly for a sleeping person. The assembly includes four corner elements, four elongated, rigid frame sections defining a rectangular perimeter of the support surface assembly, and an air-permeable layer suspended on the upper edge of the frame sections. A plurality of peripheral portions are attached to the air-permeable layer. Each of the frame sections is provided with an upper edge, inner wall, and outer wall. Two adjacent and substantially mutually perpendicular frame sections are pivotally connected to a common corner element.

Each peripheral portion of the air-permeable layer is received and secured by means of a pressure fit in a groove formed in the inner wall of a corresponding frame section. A frame contactable portion of the air-permeable layer is wrapped about the corresponding frame section upon application of a moment to each of the corresponding frame sections, tensioning the air-permeable layer and causing the corresponding frame sections to be coupled with two adjacent corner elements.

The peripheral portion is preferably attached to the air-permeable layer and includes a loop for receiving via an opening in the cover member a rod securable to walls of the groove.

The air-permeable layer is characterized by an ability to withstand fatigue tests of 500 pressing operations in which a load of 1 kg is loaded on a surface of 10 cm×10 cm with a speed of 50 mm/sec, without sagging and 2000 pressing operations in which the same load, surface and speed are applied, resulting in sagging of 2 mm at the point of impact.

In one aspect, the corner element has a convex outer wall and an arcuate inner wall both of which subtending an angle of approximately 90 degrees. Two straight interface elements extend between the outer wall and the inner wall at each terminal end thereof. Two apertures are bored in each of the interface elements by which a corresponding frame section is coupled with the corner element. The corner element may be provided with an interspace between the inner and outer walls through which attachment elements for immobilizing the corner element by means of a fixation device and for attachment to an underlying work surface pass.

In one aspect, the support surface assembly further includes a decorative shield contactable with, and securable to, the outer wall of the corner element. The outer wall of an adjacent frame section is substantially flush with the shield after being pivoted to an upright position.

In one aspect, the frame section has a cover member with a planar plate at each of its two longitudinal ends facing an adjacent corner element, an axle by which the frame section pivots and a spring biased pin protruding from the cover member for engaging the two apertures, respectively, bored in an adjacent interface element of the corner element.

In one aspect, the groove in which the peripheral portion of the air-permeable layer is received is a longitudinally extending groove that separates the inner wall of the frame section into an upper inner wall and a lower inner wall. The upper wall is oblique with respect to the outer wall such that the width of the upper edge which extends between the outer wall and upper inner wall is considerably less than the width of the bottom wall.

In one aspect, the frame section has a planar outer wall and a bottom wall substantially perpendicular to the outer wall and the lower inner wall, the bottom wall being provided with two opposed rounded portions extending to the outer wall and the lower inner wall, respectively.

In one aspect, vibratory motion of the air-permeable layer is transmitted to a movement sensor placed on a frame support by means of a vibration transmitter. The vibration transmitter includes an upper member in contact with an underside of the air-permeable layer, a lower member in contact with the movement sensor and coupled to the upper member, and spring means extending from the lower member to a surface of the upper member. The lower member oscillates in response to the vibratory motion, inducing a corresponding electrical signal by means of the movement sensor.

In one aspect, the support surface assembly further includes a plurality of pivotable legs for elevating one longitudinal end of the frame.

In one aspect, a final length of the air-permeable layer stretched over a distance between groove centers after pivoting the frame sections is 1-4% longer than the initial length before pivoting.

In one aspect, a ratio of fiber to area ratio of the air-permeable layer is between 40% and 60%, preferably between 45% and 55%.

The present invention is also directed to a method for tensioning an air-permeable layer that is suspended on a plurality of frame sections. The method includes the steps of:

a) Providing four elongated, rigid frame sections, each of the frame sections having an upper edge, an inner wall, a longitudinal groove formed in an intermediate portion of the inner wall, a bottom wall, and an outer wall, and having at each longitudinal end thereof a cover member with a planar plate substantially perpendicular to the outer wall from which protrude an axle and a spring biased pin.

b) Providing four corner elements, each of which having an upper edge, an outer wall, an inner wall, and two straight interface elements extending between the outer wall and the inner wall at each terminal end thereof, wherein upper and lower apertures are bored in each of the interface elements.

c) Placing the upper edge of each of the four corner elements on a substantially rectangular air-permeable layer, a straight peripheral portion provided with a loop being attached to each end of the air-permeable layer.

d) Coupling each of the frame sections with two of the corner elements by rotatably mounting the axle protruding from a first frame section longitudinal end within the upper aperture of a corresponding interface element of a first corner element and rotatably mounting the axle protruding from a second frame section longitudinal end within the upper aperture of a corresponding interface element of a second corner element until the four frame sections are in a pre-tensioning position such that their outer wall contacts the air-permeable layer and first and second frame sections are substantially mutually parallel and third and fourth frame sections are substantially perpendicular to the first and second frame sections.

e) Inserting each of the peripheral portions in the groove of a corresponding frame section;

f) Feeding a rod into each peripheral portion loop via an opening in a corresponding cover member which is in communication with the groove, whereby to secure a peripheral portion to corresponding walls of the groove;

g) Immobilizing the four corner elements;

h) Pivoting each of the frame sections about its two axles, causing a frame contactable portion of the air-permeable layer to be partially wrapped about the bottom wall and inner wall of a corresponding frame section and a sleeping surface of the air-permeable layer to be additionally tensioned; and i) Causing the pins protruding from the first and second frame section longitudinal ends, respectively, to be received within the lower aperture of the corresponding interface element of the first and second corner elements, respectively, so that the frame sections will assume an upright position.

In one aspect, two or more of the frame sections are concurrently pivoted.

In one aspect, a corner element is immobilized by coupling a fixation device thereto and attaching the fixation device to an underlying work surface.

In one aspect, each of the frame sections is pivoted by means of a corresponding arm assembly, the arm assembly comprising a plurality of differently oriented arms connected to a roller assembly in which are rotatably mounted three rollers that rollingly contact the outer wall, bottom wall, and inner wall, respectively, of the frame section.

In one aspect, a controller selectively controls the rate of pivoting of each of the arm assemblies to ensure that the sleeping surface of the air-permeable layer will be tensioned to a substantially uniform level.

According to a further aspect, the presently disclosed subject matter discloses a kit for constructing a support surface for a sleeping person. The kit comprises:

a. an air-permeable layer having at least one pair of opposing layer-edge portions stretchable at least in the direction between the layer-edge portions to form the support surface;

b. at least one pair of parallel opposing frame sections fixedly disposable at a distance therebetween for forming at least a portion of a frame supporting the support surface. At least a first of the frame sections comprises a layer-edge engaging portion configured for fixedly engaging a corresponding layer-edge portion; and c. a tensioning mechanism configured for moving the layer-edge engaging portion together with the layer-edge portion relative to the opposing frame section to at least partially tension the air-permeable layer between the frame sections.

The air-permeable layer can be a screen printing mesh characterized by a fiber to area ratio of between 40% and 60%, preferably between 45% and 55% or by a mesh count of greater than 14.5/cm.

The air-permeable layer can be characterized by a tensile strength greater than 1000 N.

The air-permeable layer can be characterized by an ability to allow passage of gas therethrough such that, when a head box is placed with its open face on the air-permeable layer and a gas having an initial concentration of 7% of $CO_2$ is flowed to the head box at a rate of 1.5 Liter/minute, after 5 minutes of the flow the concentration of $CO_2$ in the gas in the head box does not exceed 1%.

The air-permeable layer can be characterized by an ability to withstand 500 pressing operations in which a load of 1 kg is loaded on a surface of 10 cm×10 cm with a speed of 50 mm/sec, without sagging and 2000 pressing operations in which the same load, surface and speed are applied, resulting in sagging of 2 mm at the point of impact.

The air-permeable layer can have a long and a short dimension and stretched so that in the long dimension it is under a greater tension than in the short dimension.

The air-permeable layer of the present disclosed subject matter can be characterized by different combinations of characteristics selected from the characteristics above.

The kit can further comprise a supplementary layer to be used with the support surface, the supplementary layer being made of air-permeable mesh fiber material which is softer the material of the air-permeable layer and which has a fiber to area ratio greater than the fiber to area ratio of the air-permeable layer, the supplementary layer being configured to cover at least a majority of the air-permeable layer.

The tensioning mechanism can comprise a pivoting axis about which the layer-edge engaging portion is configured for pivoting and which is fixedly disposed relative to the opposing frame section, and a rotatable portion for exerting a rotational force, at least indirectly, on the layer-edge engaging portion.

The rotatable portion can comprise at least a portion of the frame section different from the layer-edge engaging portion, which is pivotable about the pivoting axis when the force is exerted thereon, optionally at least indirectly by a user.

The first frame section or its tensioning mechanism can have a pre-tensioned position and pivotable therefrom to a tensioned position in which its layer-edge engaging portion is spaced from the opposition frame section to a distance shorter than that in the pre-tensioned position.

The kit can further comprise at least two corner elements attachable to the first frame section at two opposite ends thereof and configured to receive therein corresponding ends of the pivoting axis so as to allow pivoting of the frame section about the axis.

The ends of the frame section can be mis-aligned with the corners when in the pre-tensioned position and aligned with the corners and fixedly attached thereto in the tensioned position.

The at least one pair of parallel opposing frame sections can be two pairs of parallel opposing frame sections forming a rectangular perimeter of the frame. The at least one pair of opposing layer-edge portions can be two pairs of opposing layer-edge portions. Each of the frame sections can comprise the layer-edge engaging portion configured for fixedly engaging a corresponding layer-edge portion and being moved by its corresponding tensioning mechanism.

The layer-edge engaging portion can be a longitudinal groove formed in the frame section configured for engaging its corresponding layer-edge portion and for securing it therein by means of pressure fit.

Each of the layer-edge portions comprises a longitudinal loop configured for being received in the longitudinal grooves and to receive a securable rod therein, so as to be secured within the groove.

The tensioning mechanism can comprise fixing means configured for causing the tensioning mechanism leave the air-permeable layer at least partially tensioned.

The frame can further comprise at least one stabilizing member. The stabilizing member can be a transverse cross bar extending transversely between the opposite frame sections. The stabilizing member can also be a corner reinforcing element configured for connecting two adjacent frame sections.

According to a still further aspect, the presently disclosed subject matter discloses a method for constructing a support surface from components which constitute the kit describes above. The method comprises at least the following steps:

a. fixedly engaging a layer-edge engaging portion with a corresponding layer-edge portion; and
b. moving the layer-edge engaging portion together with the layer edge portion relative to the opposing frame section, thereby at least partially tensioning the layer between the frame sections.

The method can further comprise a step of fixedly disposing the frame sections at a distance therebetween for forming at least a portion of a frame supporting the support surface.

The method can further comprise a step of pivoting the layer-edge engaging portion about the pivoting axis, thereby exerting a rotational force, at least indirectly on the layer-edge engaging portion by a rotatable portion.

The method can further comprise a step of pivoting the first frame section from its pre-tensioned position to a tensioned position, thereby spacing its layer-edge engaging portion from the opposition frame section to a distance shorter than that in the pre-tensioned position.

The method can further comprise a step of attaching two opposite ends of the first frame section to the corner elements by receiving therein corresponding ends of the pivoting axis so as to allow pivoting of the frame section about the axis.

According to a still further aspect, the presently disclosed subject matter discloses a support surface for a sleeping person. The support surface comprises:

a. an air-permeable layer having at least one pair of opposing layer-edge portions stretched at least in the direction between the layer-edge portions to form the support surface;
b. at least one pair of parallel opposing frame sections fixedly disposed at a distance therebetween and forming at least a portion of a frame supporting the support surface; at least a first of the frame sections comprising a layer-edge engaging portion fixedly engaging a corresponding layer-edge portion; and
c. a tensioning mechanism configured for moving the layer-edge engaging portion together with the layer-edge portion relative to the opposing frame section, thereby at least partially tensioning the air-permeable layer between the frame sections.

The tensioning mechanism can comprise a pivoting axis about which the layer-edge engaging portion is configured for pivoting and which is fixedly disposed relative to the opposing frame section, and a rotatable portion for exerting a rotational force, at least indirectly, on the layer-edge engaging portion.

The rotatable portion can comprise at least a portion of the frame section different from the layer-edge engaging portion, which is pivotable about the pivoting axis when the force is exerted thereon, optionally at least indirectly by a user.

The first frame section can have a pre-tensioned position and pivotable therefrom to a tensioned position in which its layer-edge engaging portion is spaced from the opposition frame section to a distance shorter than that in the pre-tensioned position.

The support surface can further comprise at least two corner elements attachable to the first frame section at two opposite ends thereof and configured to receive therein corresponding ends of the pivoting axis so as to allow pivoting of the frame section about the axis.

The ends of the frame section can be mis-aligned with the corners when in the pre-tensioned position and aligned with the corners and fixedly attached thereto in the tensioned position.

The at least one pair of parallel opposing frame sections can be two pairs of parallel opposing frame sections forming a rectangular perimeter of the frame. The at least one pair of opposing layer-edge portions can be two pairs of opposing layer-edge portions, each of the frame sections comprises the layer-edge engaging portion configured for fixedly engaging a corresponding layer-edge portion and being moved by its corresponding tensioning mechanism.

The layer-edge engaging portion can be a longitudinal groove formed in the frame section configured for engaging its corresponding layer-edge portion and for securing it therein by means of pressure fit.

Each of the layer-edge portions can comprise a longitudinal loop configured for being received in the longitudinal grooves and to receive a securable rod therein, so as to be secured within the groove.

The tensioning mechanism can comprise fixing means configured for causing the tensioning mechanism leave the air-permeable layer at least partially tensioned.

According to a still further aspect, the presently disclosed subject matter discloses a support surface for a sleeping person The support surface comprises:

a. an air-permeable layer having two pairs of opposing layer-edge portions stretched at least in the direction between the each pair of the layer-edge portions to form the support surface;
b. four corner elements defining a rectangular perimeter of the support surface;
c. two pairs of parallel opposing frame sections fixedly disposable at a distance therebetween, each between two corresponding corner elements. Each of the frame sections comprises a layer-edge engaging portion configured for fixedly engaging a corresponding layer-edge portion; and
d. four tensioning mechanisms each associated with its respective layer-edge engaging portion, each tensioning mechanism being configured for moving its respective layer-edge engaging portion together with the layer-edge portion relative to the opposing frame section to at least partially tension the air-permeable layer between the frame sections.

According to a still further aspect, the presently disclosed subject matter discloses a supplementary layer to be used with a support surface comprising a main mattress layer of a first air-permeable mesh fiber material having a first space-to-fiber ratio. The supplementary layer is made of second air-permeable mesh fiber material which is softer than said first material and which has a second fiber to area ratio greater than the first space-to-fiber ratio. The supplementary layer being configured to cover at least a majority of said main layer.

The supplementary layer can be made of polyester and can have a width of between 5 mm and 7 mm.

BRIEF DESCRIPTION OF THE DRAWINGS

In order to understand the invention and to see how it can be carried out in practice, embodiments will now be described, by way of non-limiting examples only, with reference to the accompanying drawings, in which.

Figure 1:
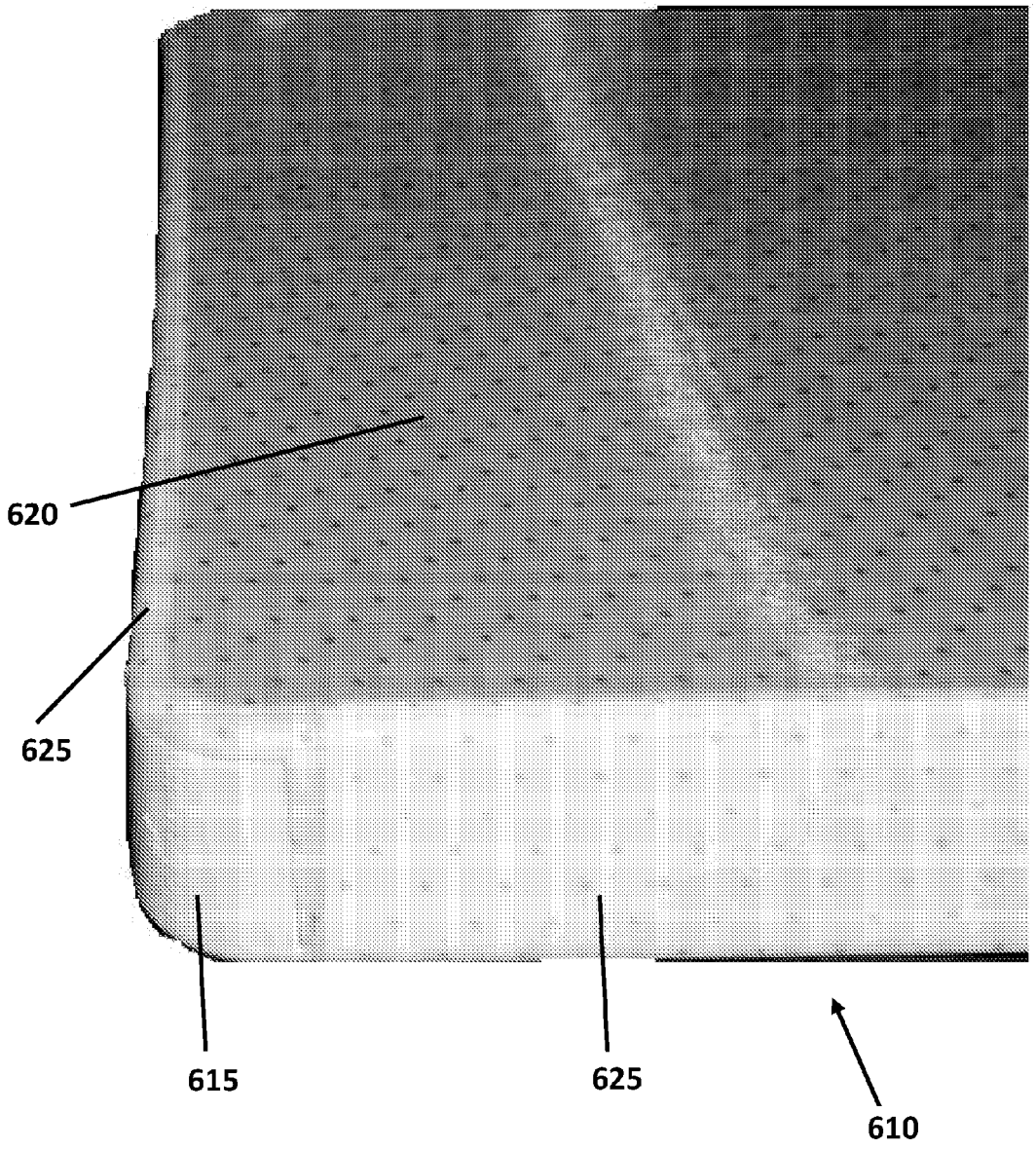
FIG. 1 illustrates a top perspective view of another embodiment of a support surface assembly.

Reference numerals of elements of the presently disclosed subject matter illustrated in FIGS. 1-16, are also presented in parentheses in FIGS. 17-22 for these elements.

DETAILED DESCRIPTION OF EMBODIMENTS

The average person spends between six to eight hours sleeping, out of a twenty-four hour day. Children and the elderly often spend even more time sleeping. It is therefore important that the construction of the mattress that one sleeps on is conducive to one's health. The present invention is concerned with providing a sleeping surface that can benefit people of all ages.

With regard to infants, it is important for an infant to be able to breathe naturally and without obstruction at all times while sleeping. Conventional mattresses are typically air-impermeable, which, therefore, blocks air flow to an infant who is sleeping in a face down position. This may cause the infant to stop breathing due to physical suffocation or by rebreathing of CO2 which may ultimately result in death. The present invention solves this problem by providing an air-permeable surface on which an infant may sleep, which enables air flow even when sleeping in a face down position. Additionally, the air-permeable surface of the present invention is constructed such that the risk of injury due to collision with a rigid frame is reduced to almost zero.

FIGS. 1-16 illustrate one embodiment for tensioning the air-permeable layer. In this embodiment, a peripheral portion of the air-permeable layer is received in a groove formed in a corresponding frame section and is secured within the groove by means of a pressure fit. The air-permeable layer is further tensioned by means of the concurrent pivoting of two or more adjacent frame sections, as will be described hereinafter.

As shown in FIG. 1, support surface assembly 610 comprises four rounded corner elements 615 and four frame sections 625 defining a rectangular perimeter. Two adjacent frame sections 625 are pivotally connected to a common corner element 615. After air-permeable layer 620 is secured to the frame sections 625, the latter are pivoted so as to be substantially flush with a wall of the corner element 615 while the tension of air-permeable layer 620 is considerably increased.

Since frame sections 625 are concurrently pivoted, the entire sleeping surface of air-permeable layer 620, i.e. suspended between opposite frame sections, is tensioned to a substantially uniformly high level. For a mattress having dimensions in the range of 0.8-1.0 m width and 1.4-1.6 m length, the sleeping surface is tensioned to a level ranging from 700 kg to 800 kg and greater than 650 kg in the longer dimension of the mattress and from 400 kg to 500 kg and greater than 350 kg in the shorter dimension of the mattress. Those tensions withstand sagging for a period of at least three years during normal infant usage.

One suitable air-permeable layer 620 is a screen printing mesh made of polyester. Such a layer has a tensile strength of greater than 1000 N that can withstand a concentrated load of greater than 400 N without being punctured and is fatigue resistant during 2000 pressure applications of 10 N/100 cm2. An exemplary air-permeable layer is the PET 1000 15/40-200 W PW screenprinting mesh manufactured by Sefar AG, Thal, Switzerland made of polyester and having a warp and weft mesh count of greater than 14.5/cm and a fabric thickness of less than 375 microns.

The tensioning of the air-permeable layer is caused by the increase of the initial distance between groove centers to a final elongated distance when the frame sections 625 are flushed with the corners 615. The elongation is kept well within the material elastic range. For example, for a PET net elongation of the initial distance is preferably kept in the range of 1-4%.

Figure 2:
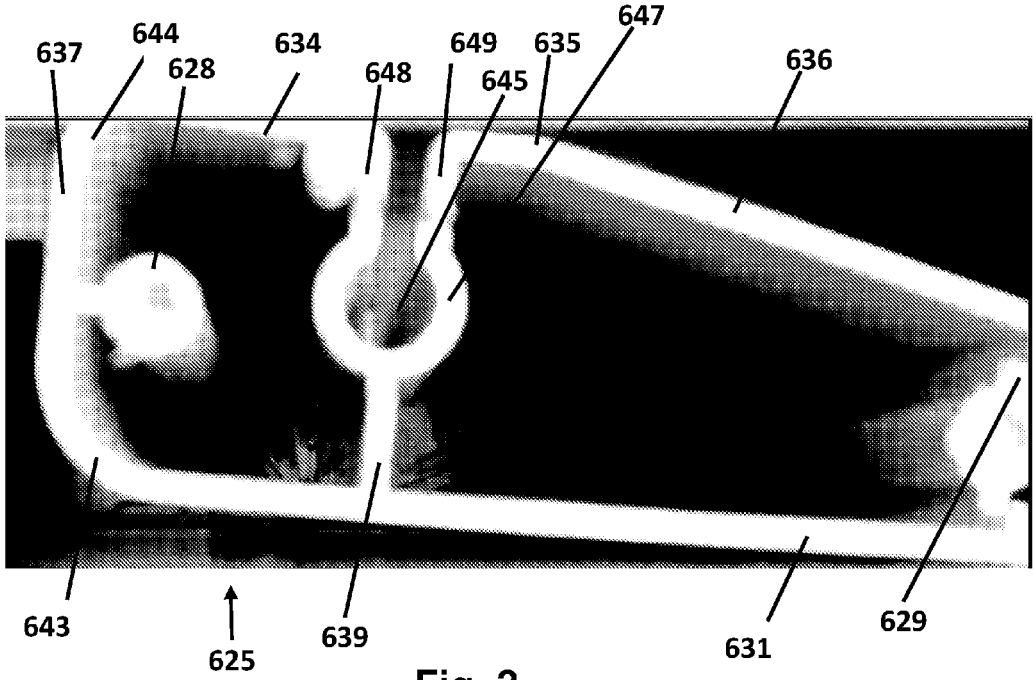
FIG. 2 illustrates a side view of a frame section used in conjunction with the support surface assembly of FIG. 1.
Figure 8:
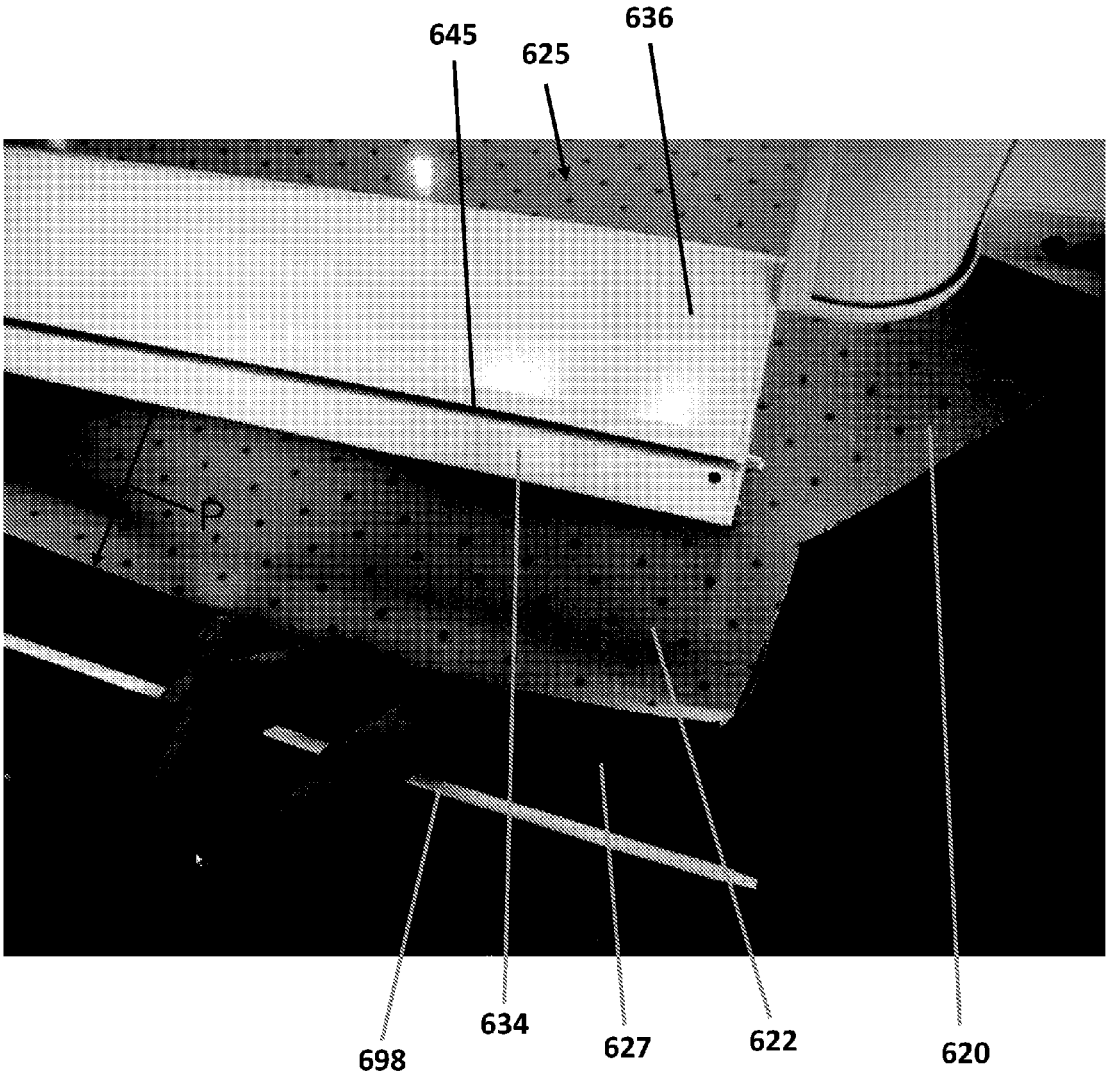
FIG. 8 illustrates a top view of a frame contactable portion of the air-permeable layer before being tensioned.
Figure 10:
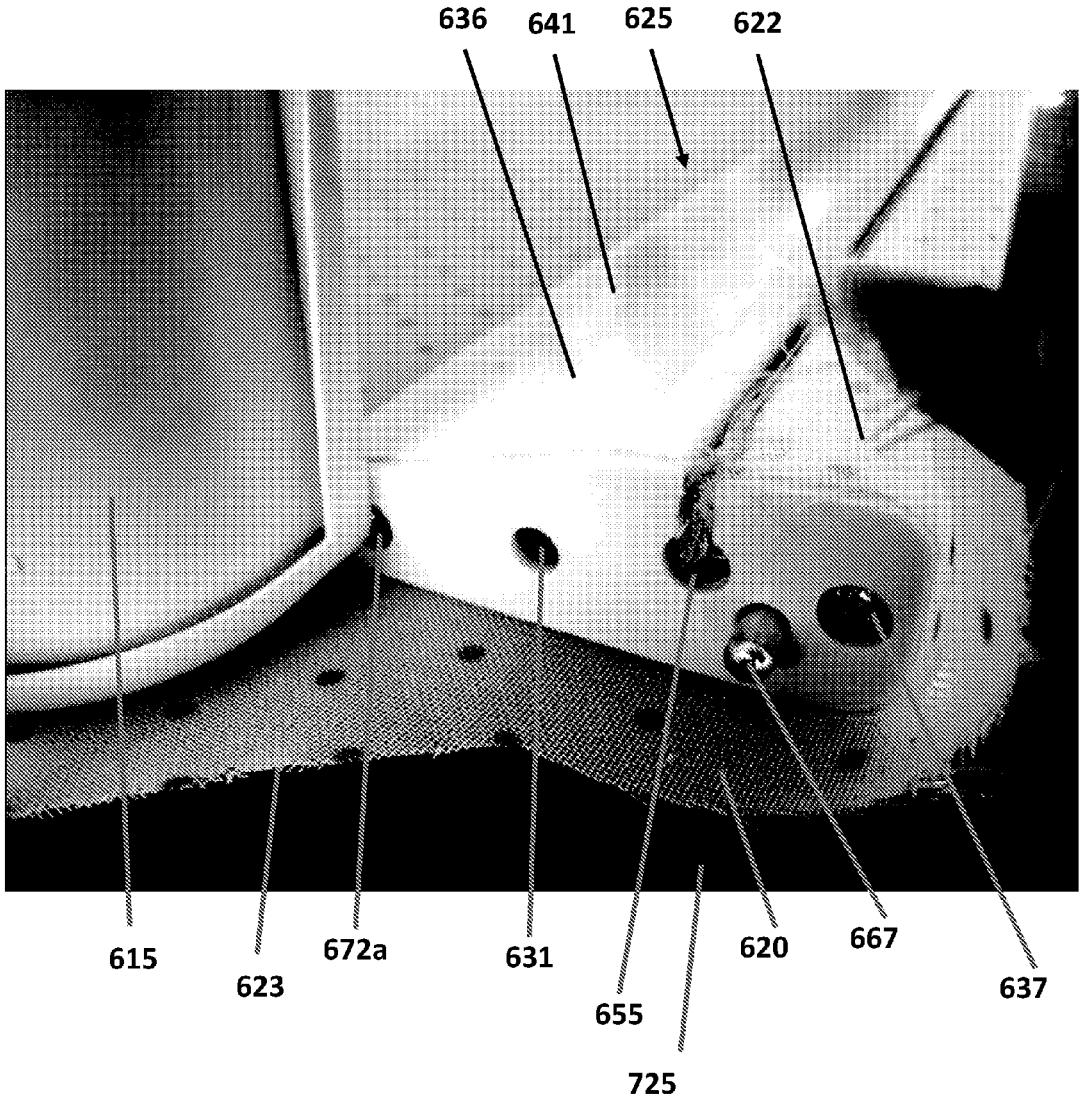
FIG. 10 illustrates a bottom perspective view from the side of a frame section of FIG. 2 in the pre-tensioning position after the air-permeable layer has been secured thereto.

As shown in FIGS. 2, 8 and 10, each frame section 625, which may be made of aluminum or of any other metallic or plastic rigid material, has a planar outer wall 631, a bottom wall 637 substantially perpendicular to outer wall 631, a lower inner wall 634 substantially parallel to wall 631, an upper inner wall 636 oblique with respect to wall 631, and two fixedly attached screw receiving elements 628 and 629. Upper inner wall 636 extends away from bottom wall 637 and terminates with upper edge 641 substantially parallel to bottom wall 637. The width of upper edge 641 ranges from 8 to 15 mm while the width of bottom wall 637 ranges from 30 to 50 mm, in order to reduce risk of injury if the sleeping person falls on the air-permeable layer in the vicinity of frame section 625. Bottom wall 637 is provided with rounded portions 643 and 644 extending to outer wall 631 and lower inner wall 634, respectively, to ensure that air-permeable layer 620 will not tear when being secured to frame section 625 and subsequently tensioned.

Longitudinal groove 645, in which the peripheral portion of air-permeable layer 620 is secured, is defined by an arcuate wall 647 subtending an angle of approximately 330 degrees, and by mutually parallel guide elements 648 and 649 extending from arcuate wall 647 to lower inner wall 634 and intermediate wall 635, respectively, for the insertion therebetween of the peripheral portion. Longitudinal groove 645 has an axis which is substantially parallel to outer wall 631. Intermediate wall 635 is adjacent to inner wall 636 and substantially parallel to outer wall 631. A reinforcing rib 639 extends from arcuate wall 647 to outer wall 631.

Figure 3:
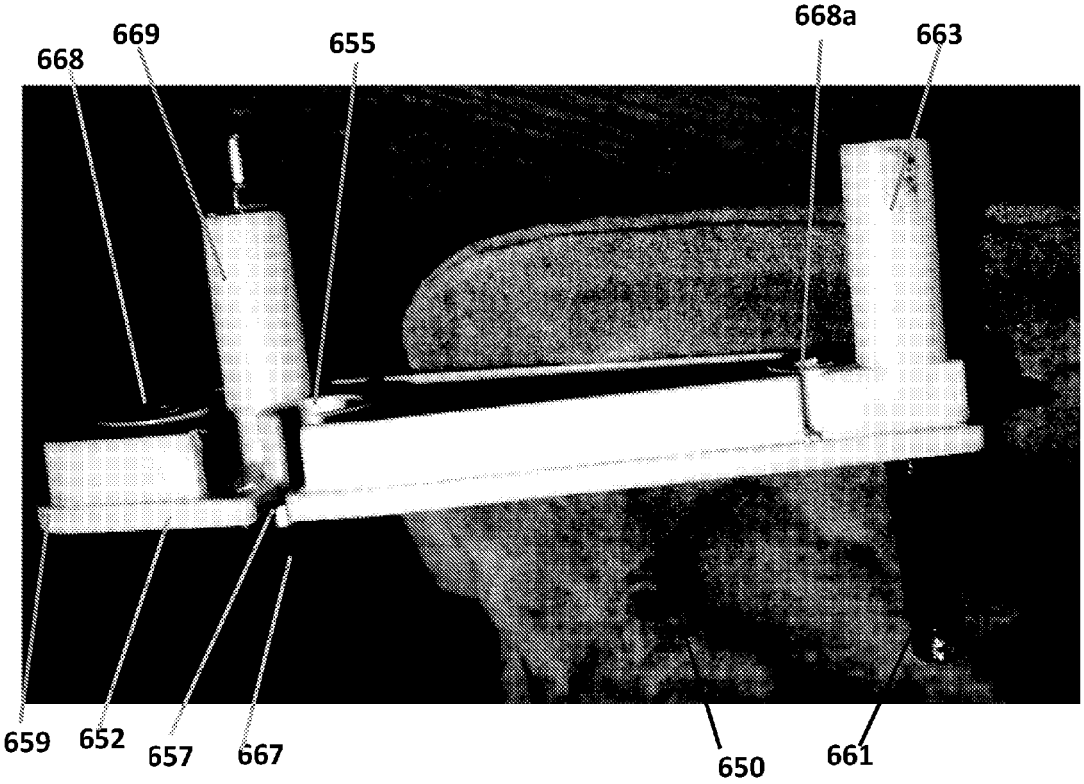
FIG. 3 illustrates a side view of a cover member connectable to the frame section of FIG. 2.
Figure 4:
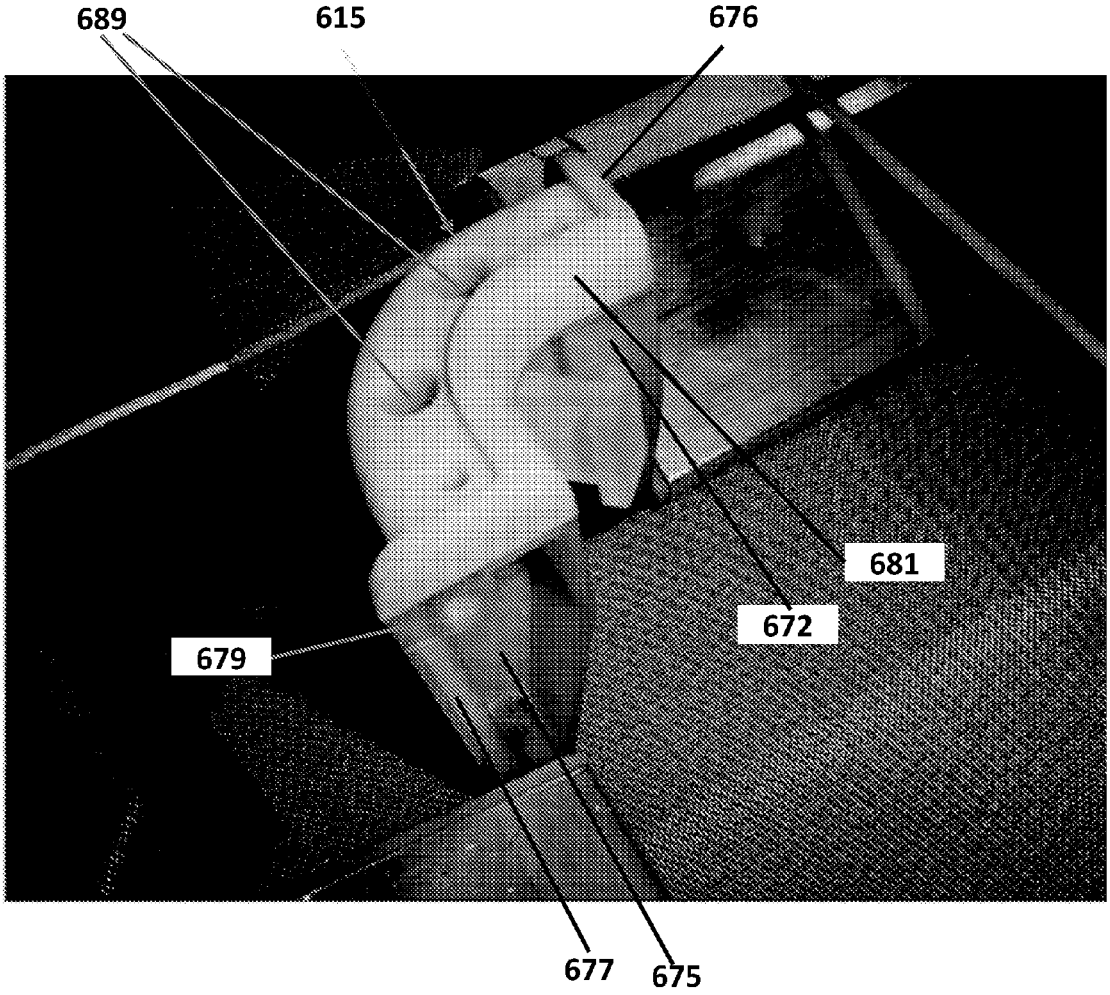
FIG. 4 illustrates a bottom perspective view from the side of a corner element used in conjunction with the support surface assembly of FIG. 1.

Cover member 650 connectable to frame section 625 is illustrated in FIGS. 3 and 4. Cover member 650 has a plate 652 that faces an adjacent corner element and is shaped with a similar profile as frame section 625. Walls of aperture 655 and slot 657 formed in cover member 650 are shaped similarly as groove 645 shown in FIG. 2. To allow the pivoting of frame section 625 relative to a corner element, cover member 650 is provided with an axle 661 mounted within mount 663 laterally protruding from plate 652 in the proximity of upper edge and with a pin 667 of FIG. 5 biased by means of spring assembly 669 laterally protruding from plate 652 between slot 657 and bottom edge 659. Apertures 668 and 668*a* formed in plate 652 are aligned with screw receiving elements 628 and 629, respectively, so that cover member 650 can be connected to frame section 625.

Figure 5:
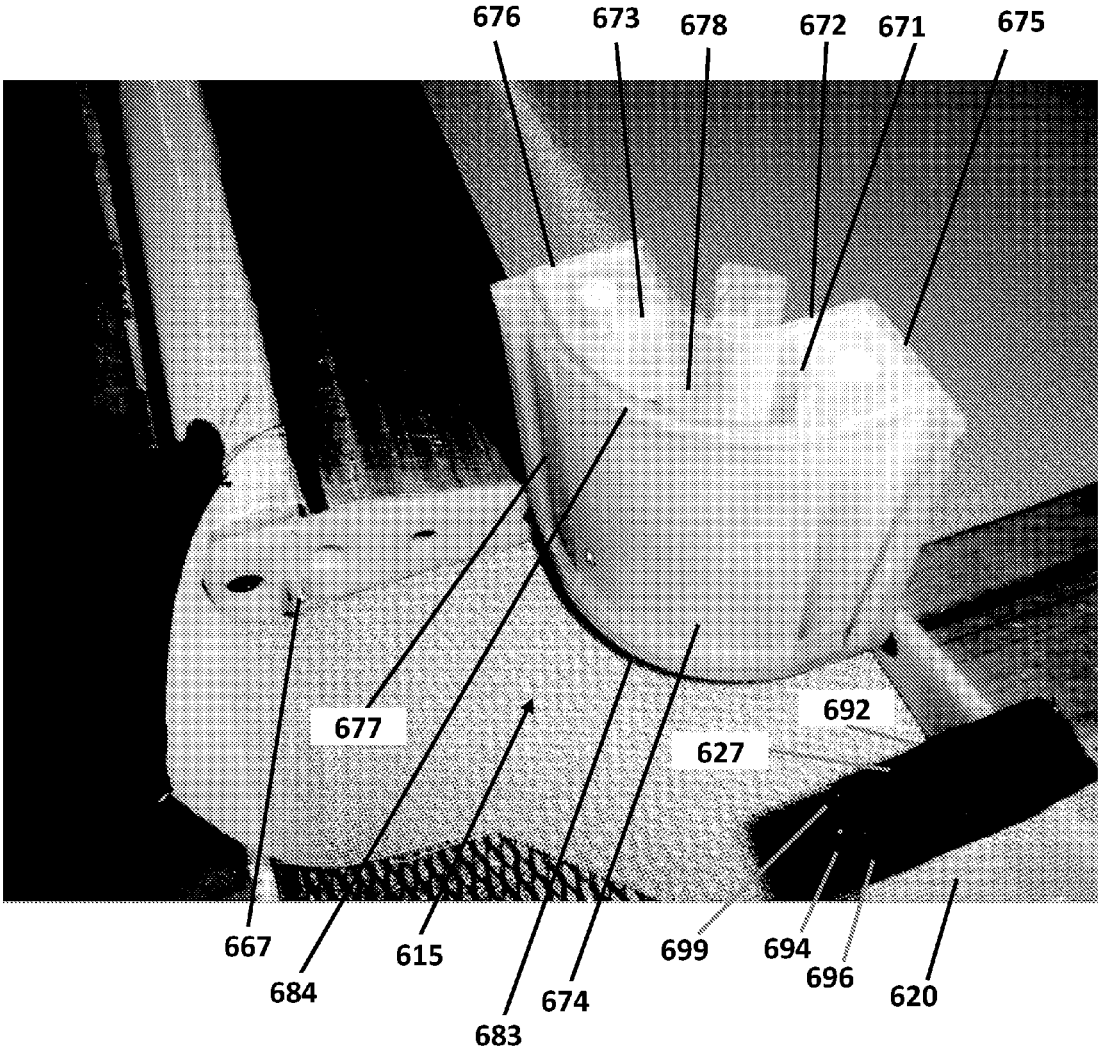
FIG. 5 illustrates a bottom perspective view of the corner element of FIG. 4 when its bottom cover is removed and two frame sections coupled thereto are in the pre-tensioning position.
Figure 6:
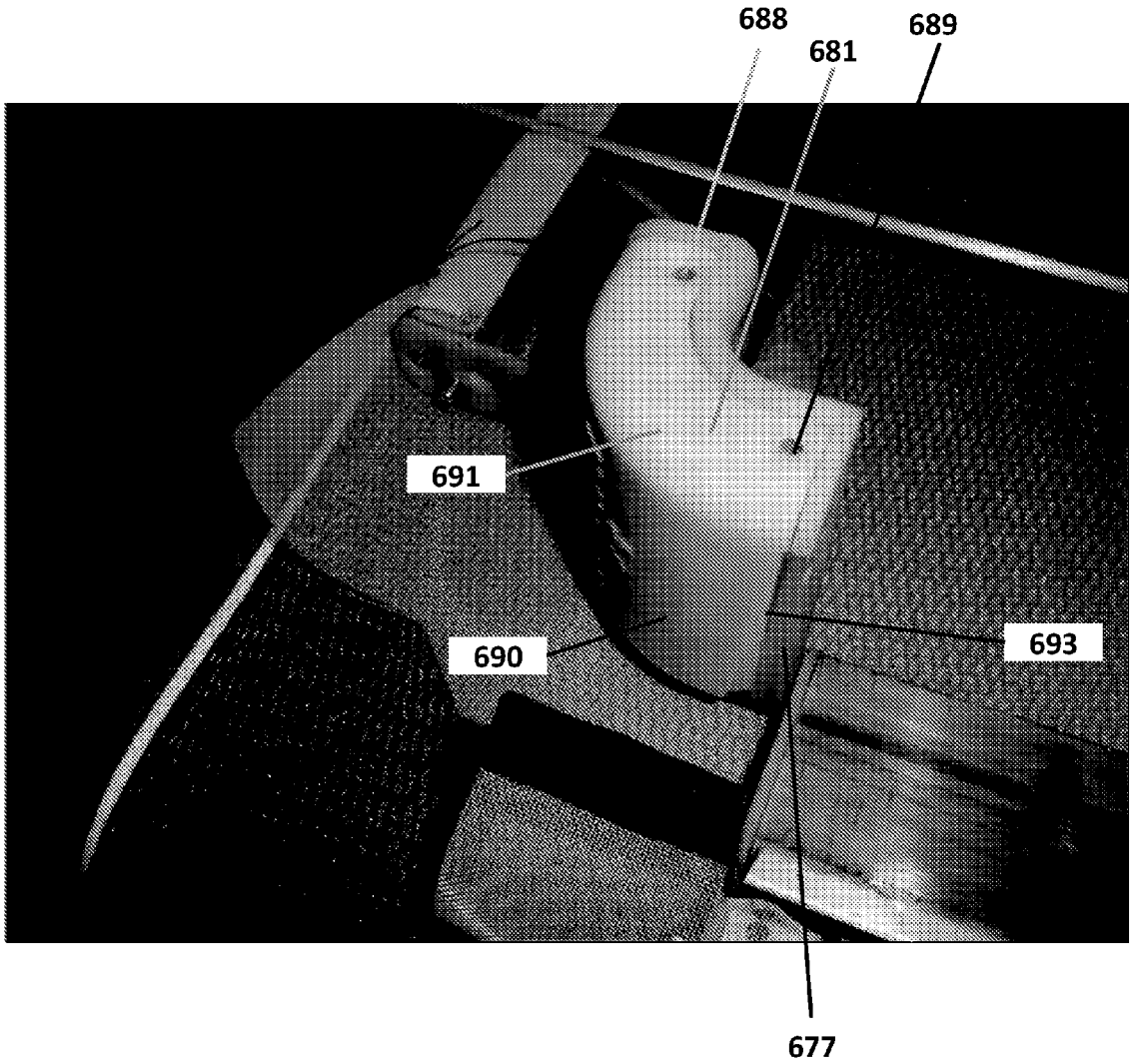
FIG. 6 illustrates a bottom perspective view of the corner element of FIG. 4, showing a decorative shield attached thereto.

FIGS. 4-6 illustrate corner element 615. Corner element 615 has an arcuate inner wall 672 and an outer wall 674 surrounding inner wall 672, both of which subtending an angle of approximately 90 degrees and terminating at the two straight ends thereof with interface elements 675 and 676, respectively. By providing corner element 615 with such a rounded configuration, the frame sections of the support surface assembly can be placed in abutting relation with the end and side units of the bed which supports the support surface assembly, without having to leave a clearance in the vicinity of a corner, as has been necessary heretofore with respect to prior art support surface assemblies having a rigid frame due to the configuration of the bed. Since the support surface assembly frame sections of the present invention are placed in abutting relation with the end and side units of the bed, a risk of being injured by a frame section if the sleeping person falls on the air-permeable layer is negligible or non-existent. It will be appreciated, however, that the support surface assembly of the present invention will also provide a uniformly tensioned air-permeable layer of a high level when a rectilinear corner element is employed.

Each interface element 675, 676 extends radially outwardly from inner wall 672 and has a protruding portion 677 which protrudes from outer wall 674. An upper aperture 672*a* shown in FIG. 10 and a lower aperture 679 are bored in each interface element, and are adapted to receive axle 661 and pin 667, respectively. Interface elements 675 and 676 are configured with planar, rectangular abutment plates 671 and 673, respectively, each of which being substantially coplanar with bottom edge 684 of corner element 615 and extending between inner wall 672 and outer wall 674. Corner element 615 has a hollow interior 678 defined by the interspace between inner wall 672 and outer wall 674 and between abutment plates 671 and 673, and an upper surface 683 provided with two apertures (not shown).

Corner element 615 may also have a bottom cover 681 attachable to abutment plates 671 and 673, or otherwise integrally formed with the corner element. Cover 681 has a recessed surface in which are formed large-holed apertures 688 and 689, by which an immobilizing device can be coupled, as will be described hereinafter. A decorative shield 690 contacting outer wall 674 may be attached to corner element 615 such that bottom surface 691 of the shield will be substantially coplanar with bottom cover 681 and each circumferential edge 693 of the shield will contact protruding portion 677 of the corner element.

An exemplary cover element may be made of nylon reinforced with glass fibers, e.g. PA6 and GF 40%, with its inner and outer walls having a thickness of 3-4 mm. The decorative shield may be made of ABA (Acrylonitrile Butadiene Styrene).

Figure 7:
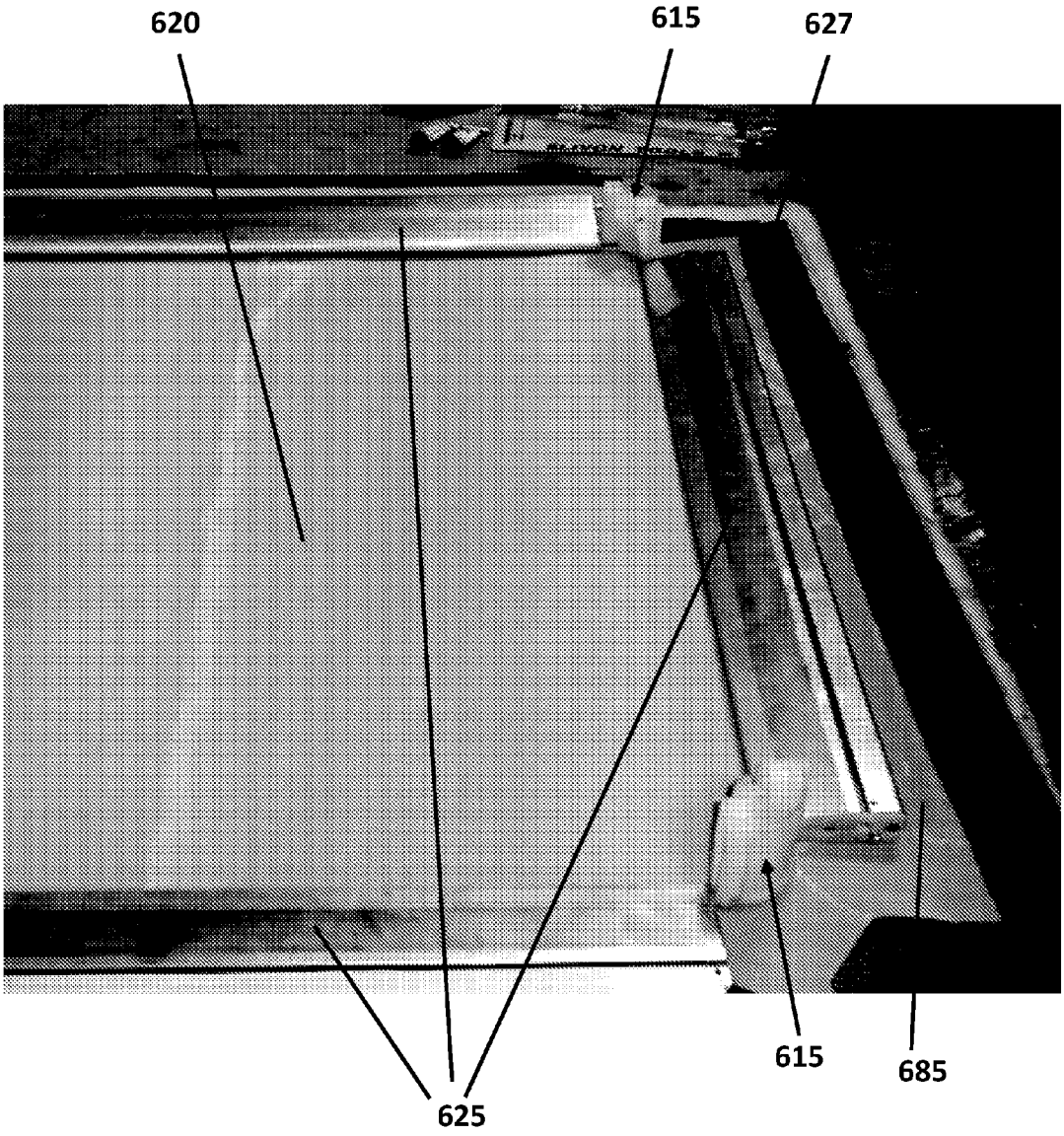
FIG. 7 illustrates a top view of the air-permeable layer before being tensioned, showing a plurality of frame sections and corner elements placed thereon.

FIG. 7 illustrates air-permeable layer 620 before being tensioned. The upper edge of four corner elements 615, to each of which the axle 661 but not the spring biased pin 667 of two perpendicularly oriented frame sections 625 is rotatably mounted, is placed on air-permeable layer 620. Peripheral portion 627 is attached to the entire periphery of a rectangular region 685 of the air-permeable layer, with the exception of its corners, from each of which an angled cutout is formed in order to accommodate the pivoting of the frame sections 625 and the consequent tensioning of the air-permeable layer.

Peripheral portion 627 is illustrated in greater detail in FIG. 5. Peripheral portion 627 is two-ply flexible material stitched together and to edge 696 of air-permeable layer 620. The two-ply material is unstitched from terminal edge 692 of peripheral portion 627 to an intermediate region 695 thereof, to define a loop 694 therebetween. Peripheral portion 627 is stitched to air-permeable layer 620 by any suitable stitching method. The peripheral portion is strong enough to resist detachment therefrom when the air-permeable layer is tensioned.

FIG. 8 illustrates frame contactable portion 622 of air-permeable layer 620. Frame contactable portion 622 protrudes from frame section 625, which overlies the air-permeable layer 620, by a dimension P that takes into account the amount of material needed to be wrapped around outer wall 631, bottom wall 637, and lower inner wall 634 of frame section 625 shown in FIG. 2, as well as the amount of material that is elongated while air-permeable layer 620 is being tensioned during pivoting of the frame sections 625.

With reference also to FIGS. 2, 3, and 5, the peripheral portion 627 of each side of air-permeable layer 620 is then inserted in groove 645 of the corresponding frame section 625 such that its terminal edge 692 contacts, or is substantially in contact with, arcuate wall 647 of the groove so that loop 694 of the peripheral portion will be accessible to aperture 655 of cover member 650. Following insertion of peripheral portion 627 within a corresponding groove 645, rod 698 is used to secure the peripheral portion within the groove. Rod 698, which may be cylindrical, has a thickness equal to, or slightly greater than, the inner diameter of arcuate wall 647 and a length substantially equal to that of upper inner wall 636.

Figure 9:
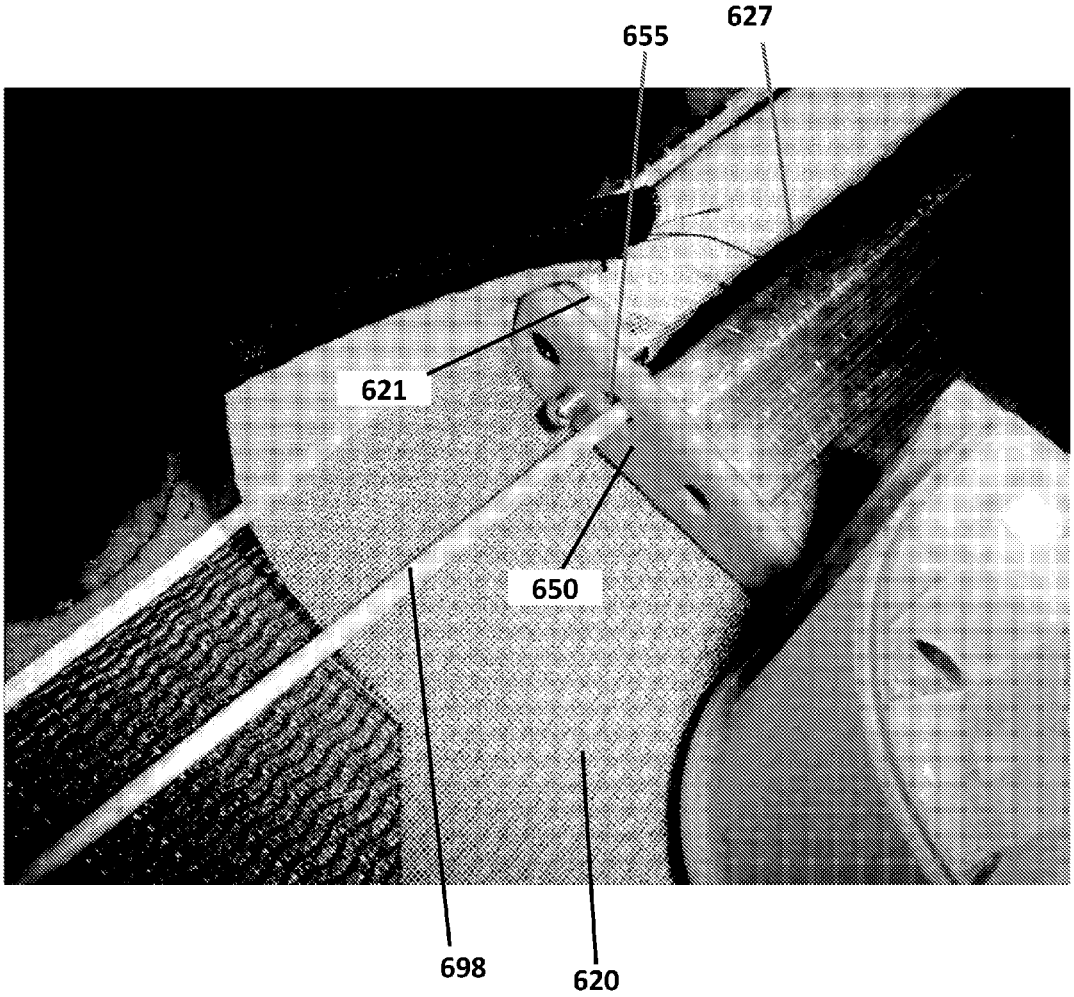
FIG. 9 illustrates a bottom perspective view of a frame section of FIG. 2 in the pre-tensioning position, showing a rod being fed via an aperture of the cover member of FIG. 3 into a peripheral portion of the air-permeable layer in order to be secured to a groove formed in the frame section.

In FIG. 9, rod 698 is shown to be inserted within aperture 655 of cover member 650. Upon longitudinal displacement of rod 698, the latter is fed into the loop of peripheral portion 627. The loop is caused to be expanded by rod 698 and consequently secured to arcuate wall 647 by a pressure fit. Air-permeable layer 620 is cut to form a longitudinal edge 621 thereof in the vicinity of cover member 650.

Figure 11:
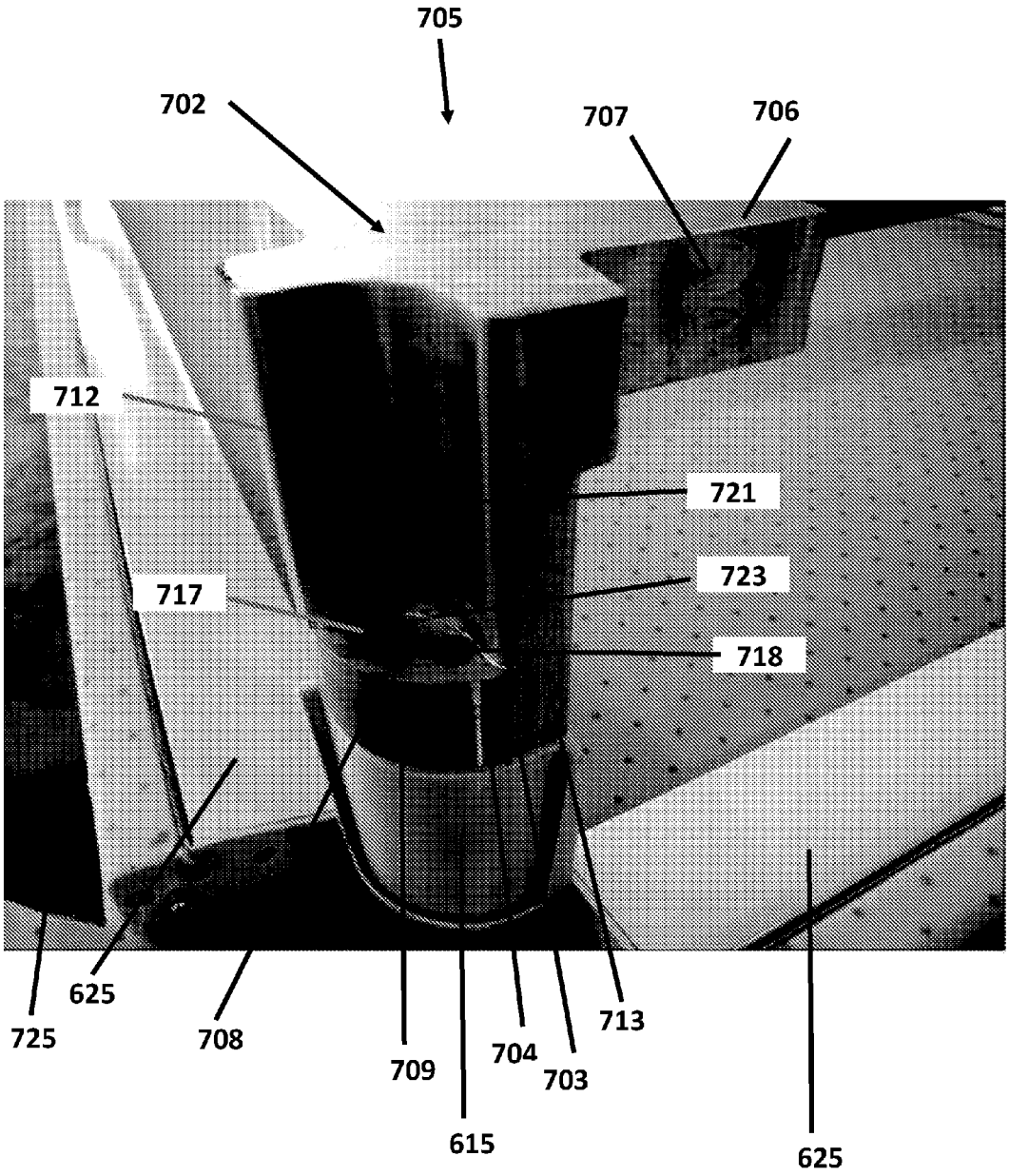
FIG. 11 illustrates a top perspective view of a fixation device coupled to the corner element of FIG. 5.

Frame section 625 is shown to be in a pre-tensioning position in FIG. 10 while its outer wall 631 is substantially parallel to the underlying work surface 725 and frame contactable portion 622 of air-permeable layer 620 is secured thereto. Air-permeable layer 620 is also cut in the vicinity of corner element 615 to form a cross edge 623. Air-permeable layer 620 is ready to be tensioned after each longitudinal edge 621 and cross edge 623 is formed As shown in FIG. 11, a fixation device 705 is used in order to immobilize each corner element 615 while the plurality of frame sections 625 are being pivoted. Fixation device 705 comprises a plurality of unitary connecting members 702, each of which is adapted to be coupled to a corresponding corner element 615, and a plurality of bars 706, e.g. rectangular bars, each of which extends between two adjacent corner elements 615. A connecting member 702 comprises an engagement element 703 contactable with the corresponding corner element 615, a block element 707 to which two bars 706 are connected, and a force applying element 712 vertically extending from block element 707 to engagement element 703. To ensure that a corner element 615 will remain immobilized, each block element 707 is thick and preferably made of metal or any other heavy and rigid material.

With reference also to FIG. 11, an exemplary engagement element 703 is provided with a convex sidewall having a similar curvature as outer wall 674 of corner element 615 and circumferentially extending between interface elements 675 and 676, an upper planar surface 708 substantially perpendicular to sidewall 704, and a planar underside 709 for contacting bottom edge 684 of corner element 615 and abutment plates 671 and 673. Two apertures 717 and 718 are bored in engagement element 703, to allow two respective bolts to be introduced through surface 708 and abutment plates 671 and 673, respectively, and then to be secured to the underlying work surface 725.

Force applying element 712 has a vertical concave surface 721 whose bottom edge 723 borders apertures 717 and 718 as well as sidewall 704. A substantially planar portion 713 vertically extends from sidewall 704 to block element 707, being disposed inwardly from concave surface 721. Since block element 707 is massive, its weight is transmitted to engagement element 703 by means of force applying element 712, causing corner element 615 to be immobilized.

Figure 12:
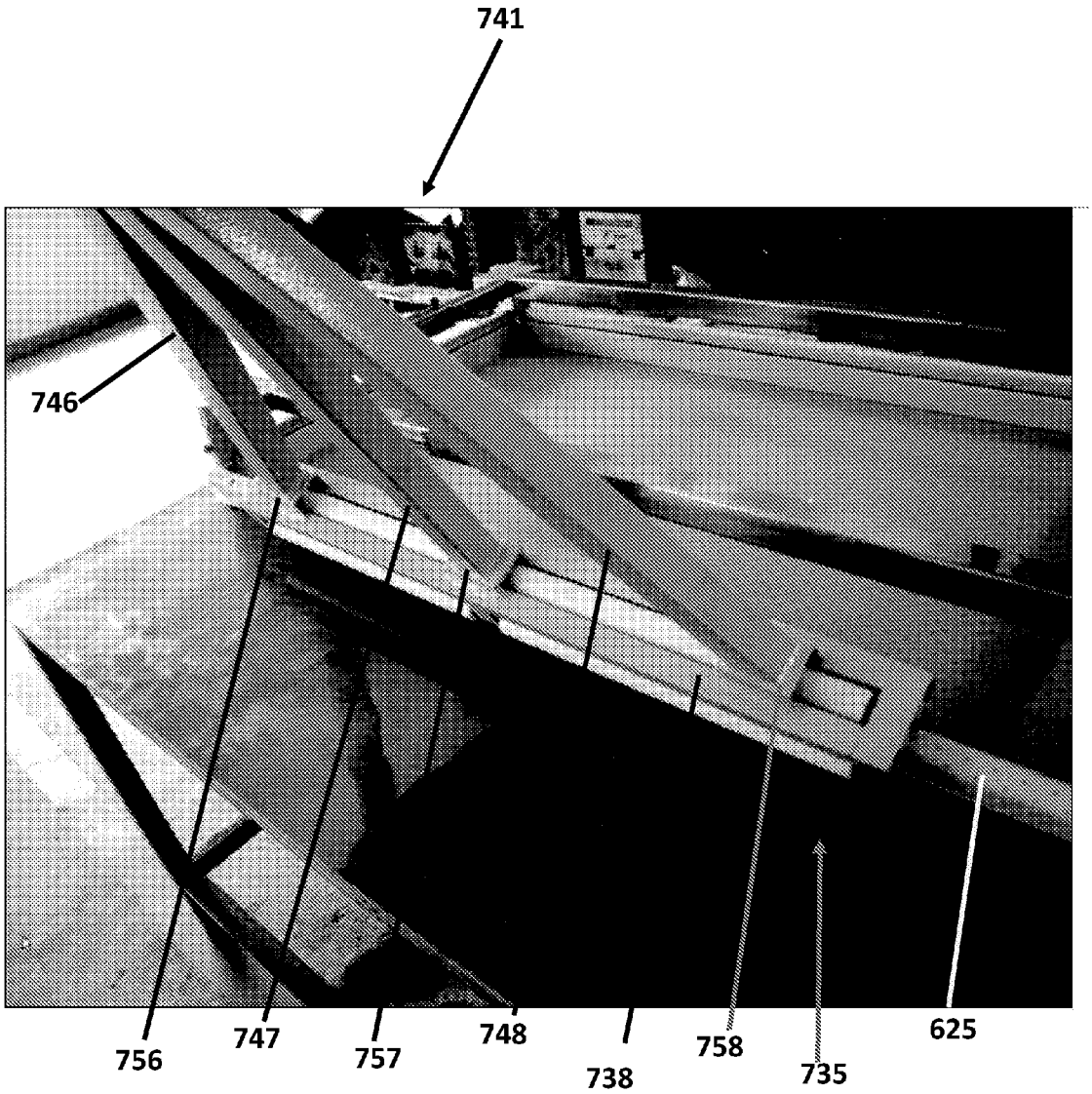
FIG. 12 illustrates a perspective view from the side of an arm assembly effecting the pivoting of the frame section of FIG. 10.
Figure 13:
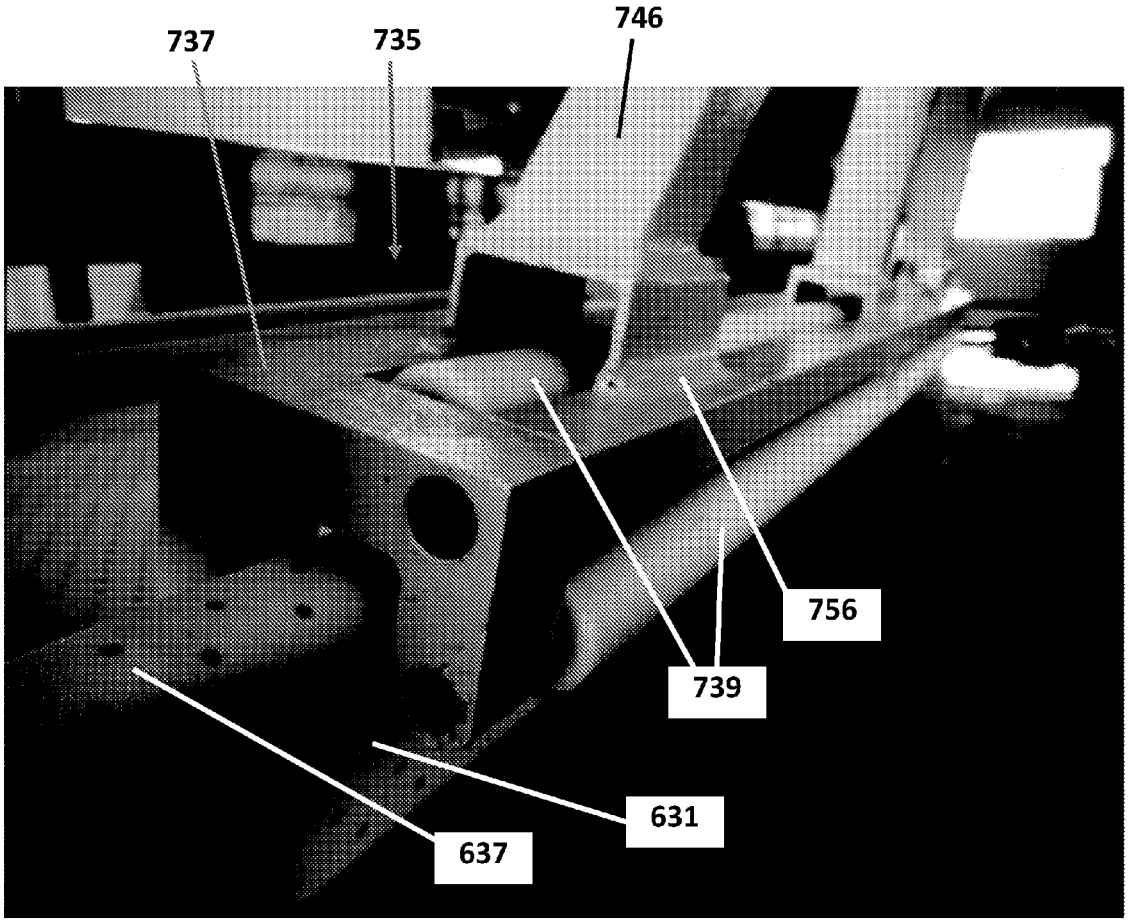
FIG. 13 illustrates a perspective view from the top of a roller assembly connected to the arm assembly of FIG. 12 when the frame section of FIG. 10 is set in an upright position.

In order to pivot a frame section 625 and to thereby cause the air-permeable layer to be tensioned, a roller assembly 735 shown in FIGS. 12 and 13 is brought in pressure contact with a frame section 625 set in the pre-tensioning position. An arm assembly 741 connected to roller assembly 735 is used to transmit a moment applied thereto.

Roller assembly 735 comprises a U-shaped housing 737 in which are rotatably mounted three rollers 739. The three rollers 739 are adapted to rollingly contact outer wall 631 bottom wall 637, and upper inner wall 636 of frame section 625, respectively, to avoid tearing or severing of the air-permeable layer 620 when being tensioned. Each of the rollers 739 may be manually positioned to be in pressure contact with frame section 625, or alternatively, may be automatically positioned, e.g. by means of pneumatically actuated cylinders for displacing a roller to a desired position. The three rollers 739 are placed in sufficiently high pressure contact with frame section 625 such that a force applied to roller assembly 735 will cause frame section 625 to be correspondingly displaced without slip.

Three arms 746, 747 and 748 of arm assembly 741, which may be coplanar, are connected to base 738 of roller assembly housing 737 at different angles. Consequently, arm 746 is connected at region 756 in the vicinity of a first longitudinal end of base 738, arm 748 is connected at region 758 in the vicinity of a second longitudinal end of base 738, and arm 747 is connected at region 757 in the vicinity of an intermediate region of base 738 between regions 756 and 758, while the three arms are connected together at a distance from base 738. Thus a single moment applied to arm assembly 741 may be substantially evenly distributed to regions 756, 757 and 758 so that the air-permeable layer will be evenly tensioned when base 738 is pivoted.

FIG. 12 illustrates frame section 625 as it is being pivoted, and FIG. 13 illustrates frame section 625 in an upright position after being pivoted. In the upright position, the frame contacting portion of the air-permeable layer becomes tensioned after being wrapped about outer wall 631 and bottom wall 637 of frame section 625, causing the sleeping surface of the air-permeable layer to be tensioned as well.

Figure 14:
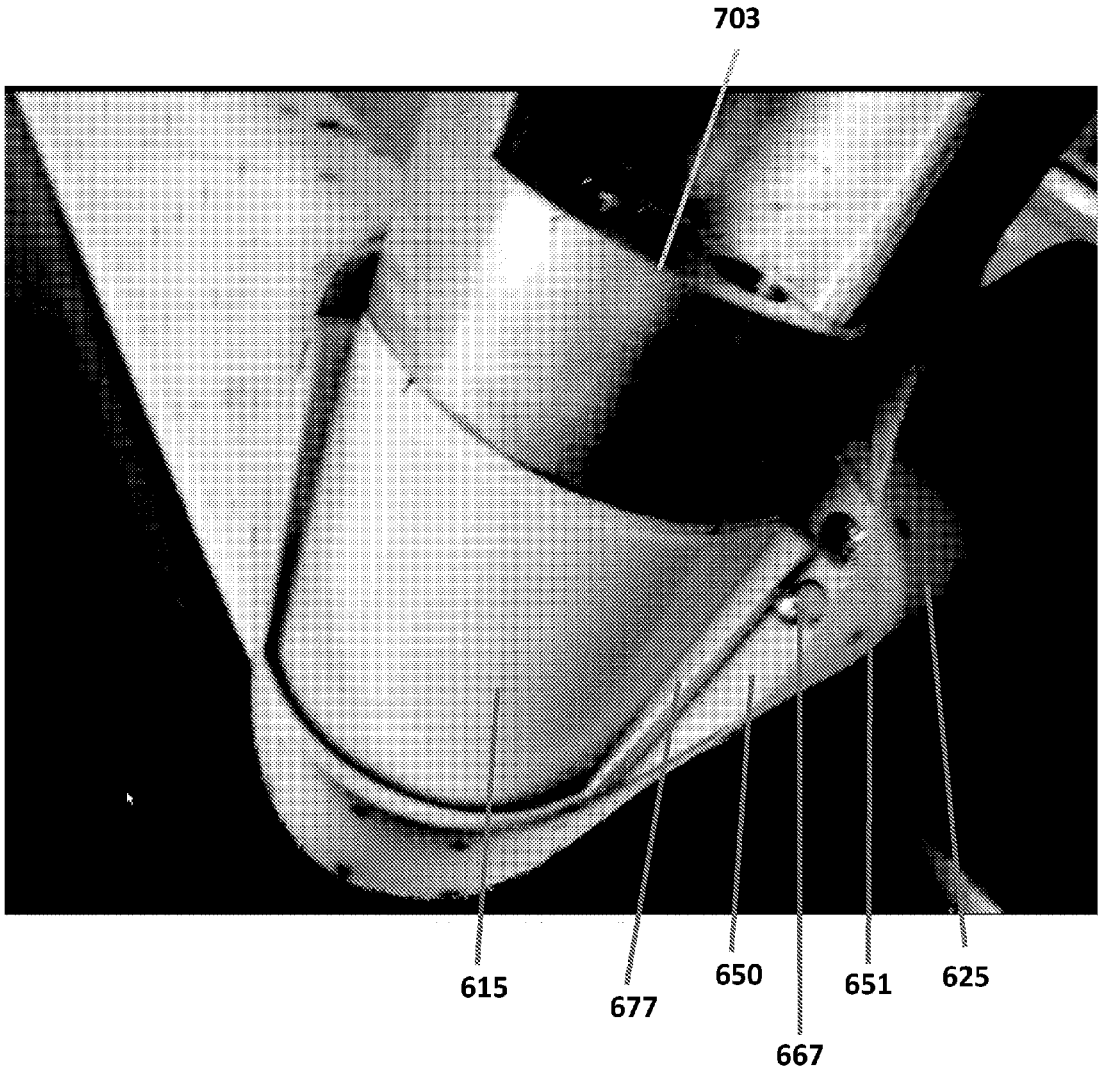
FIG. 14 illustrates a side perspective view of the fixation device of FIG. 11, showing a pin of the frame section of FIG. 10 prior to being engaged with an aperture bored in the corner element of FIG. 14.

FIG. 14 illustrates frame section 625 directly before being set in the upright position. Spring biased pin 667 is shown to be protruding from cover member 650. After frame section 625 is additionally pivoted, pin 667 contacts protruding portion 677 of corner element 615 and is caused to be retracted. When frame section 625 is set in the upright position, pin 667 becomes engaged with aperture 679 shown in FIG. 4, to prevent detachment of frame section 625 from corner element 615. After frame section 625 is set in the upright position, engagement element 703 is separated from corner element 615 and shield 690 shown in FIG. 6 is attached to corner element 615. When shield 690 is attached to corner element 615, additional portions 651 of the air-permeable layer that are not wrapped about frame section 625 will be covered and tensioned by shield 690.

Two or more frame sections 625 may be concurrently pivoted by means of the concurrent displacement of a corresponding number of arm assemblies 741.

One may design a concurrently pivoting mechanism. for the arm assemblies 741 of FIGS. 12 and 13. In a different embodiment, illustrated in FIG. 15*a* and FIG. 15*b*, an exemplary mechanism 800 is used for concurrently pivoting two arm assemblies 802 to provide a uniformly high tensioning of the air-permeable layer. A worktable 805 has four elevated corners 820 to support fixation beams 810, which are attached to corners 615 using the apertures 688 and 689 therein. Two beams 825 extend between two supporting sides of the worktable 805, serving as a solid basis for four arm assemblies 802, one pair of arm assemblies 802 for pivoting the short frame sections 625*a* and another pair of arm assemblies for the long frame sections 625*b*.

Figure 15A:
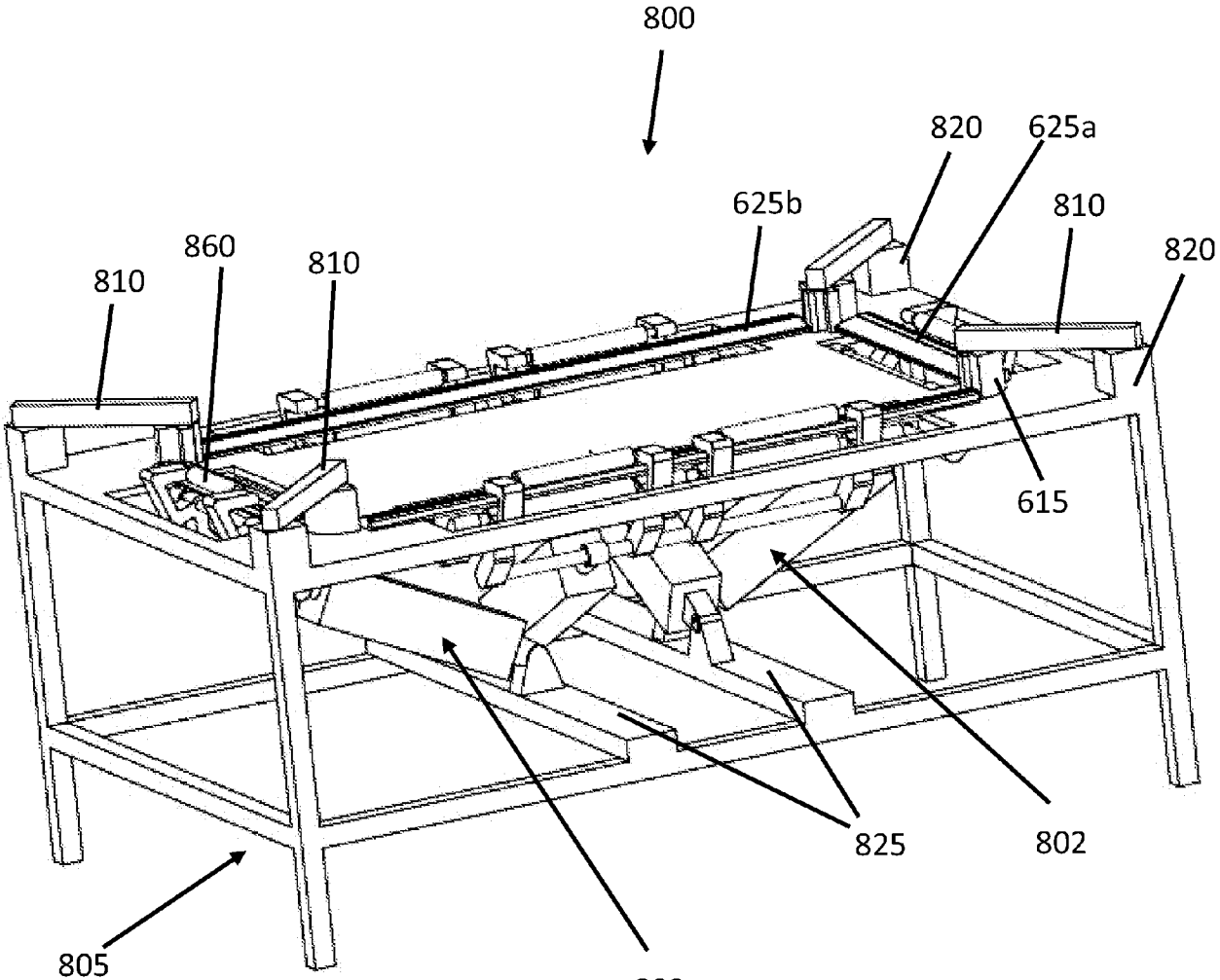
FIG. 15*a* schematically illustrates an exemplary mechanism for concurrently pivoting two arm assemblies of FIG. 12 and to provide a uniformly high tensioning of the air-permeable layer.
Figure 15B:
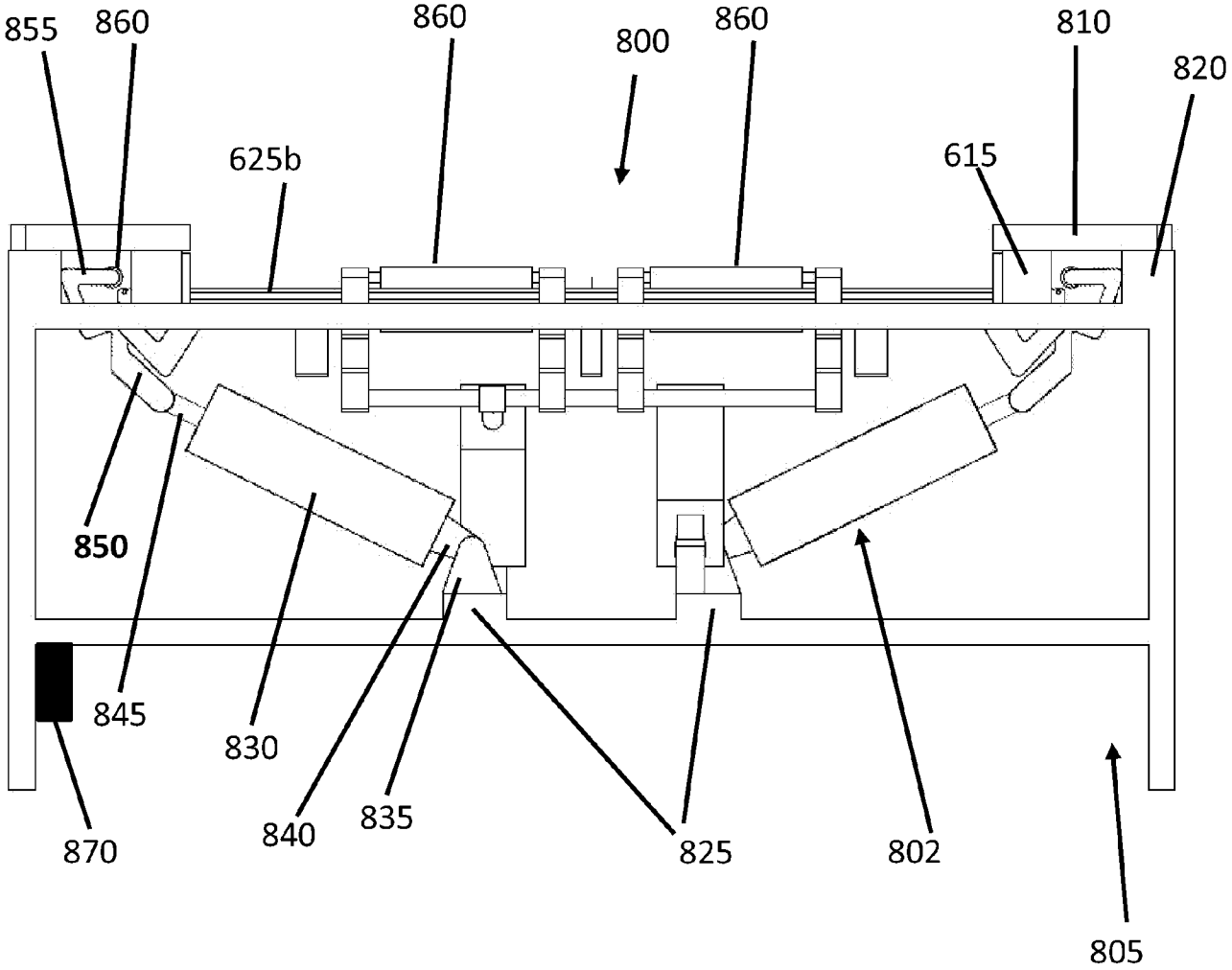
FIG. 15*b* schematically illustrates a controller operable in conjunction with the mechanism of FIG. 15 for selectively controlling the rate of pivoting of a plurality of arm assemblies of FIG. 12.

Referring now to FIG. 15*b*, the four arm assemblies 802 are shown. The arm assembly includes a beam interface 835 pivotably joined by a rod (not shown) to a sleeve base 840, a piston casing 830, a piston 845 pivotably connected to a rod holder 850, and a roller assembly 855 having four rollers 860. The roller assembly 855 holds the respective frame section 625*b*, and outward motion of piston 845 is translated to a pivoting motion of the respective frame section 625*b* the piston 845 are driven electrically or pneumatically under an electronic control of a controller 870. A single controller 870 may drive the four pistons 845 directly or through a drive unit for each piston. Thus, the pivoting of the two pairs of frame sections 625 may be conducted concurrently, to provide uniform tensioning of the air-permeable layer 620.

The controller 870 may selectively control the operation of two drive units so that the corresponding arm assemblies will pivot at such a rate that the tension of the entire sleeping surface of the air-permeable layer will be tensioned to a substantially uniformly high level. A motion sensor in electrical communication with controller may be operatively connected to two or more pivot members. When a motion related parameter of a pivot member, e.g. angular velocity, is indicative that the tension of one region of the air-permeable layer will be greater than another region, the controller 870 commands one of the drive units to reduce the force applied to the corresponding piston.

Figure 16A:
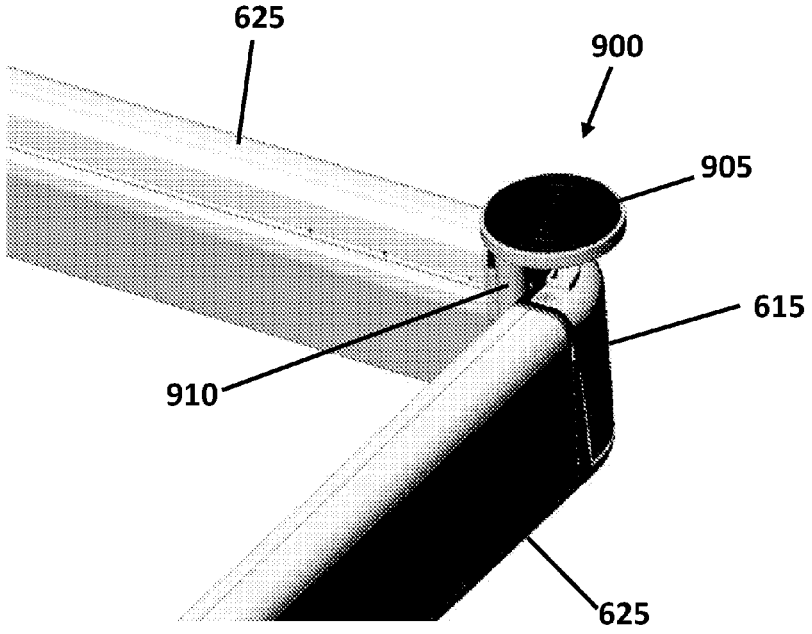
FIG. 16*a* is an isometric view of a surface assembly having a pivotable leg for elevating one longitudinal end of the assembly.
Figure 16B:
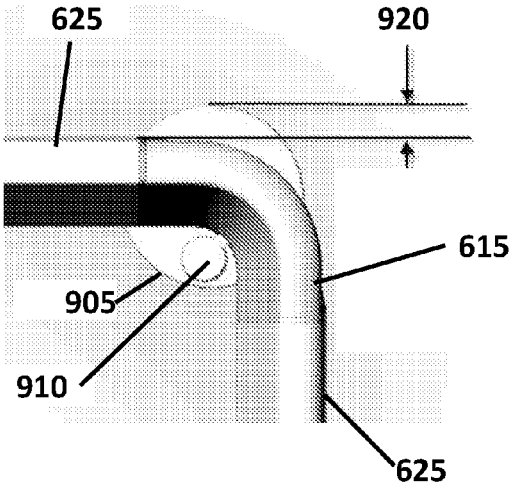
FIG. 16*b* is an upper view of a surface assembly having a pivotable leg for elevating one longitudinal end of the assembly.
Figure 16C:
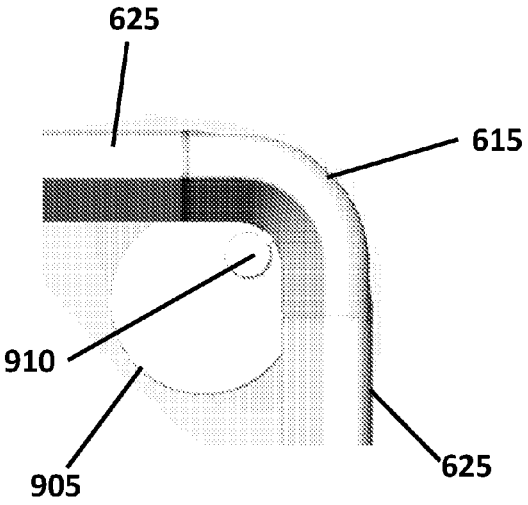
FIG. 16*c* is an upper view of a surface assembly having a pivotable leg of FIGS. 16*a* and 16*b* in a non-active state.

Referring now to FIGS. 16*a*, 16*b*, and 16*c*, a pivotable leg 900 for elevating one longitudinal end of the assembly is shown. The leg 900 includes a base 905 and a post 910, which is pivotably coupled the corner 615. As shown in the upper view of FIG. 16*b*, the leg 900 provides both elevation of the mattress relative to the bed frame, and compensation for a small difference 920 between bed size and respective size of the mattress. In the pivoted state of FIG. 16*c*, the leg base 905 is directed inward for a case no such a compensation is desired.

FIGS. 17-22 illustrate another example of a kit 100 for construction of a support surface 10 (shown in FIGS. 22A-B) having an air-permeable layer 10 and that can be used for a sleeping person (e.g., for infants and those suffering from allergies) and that enables effortless breathing through it.

Figure 17:
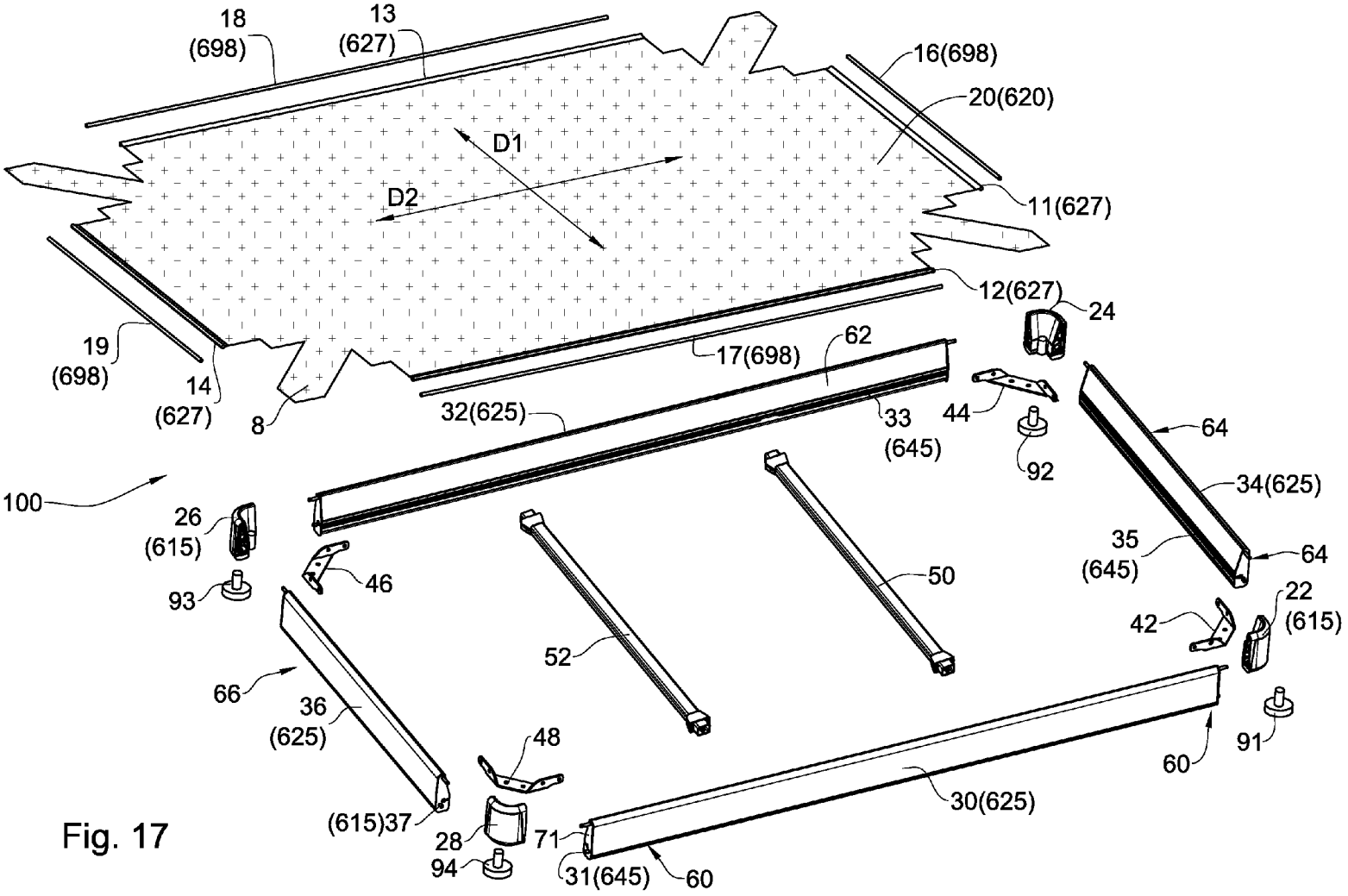
FIG. 17 illustrates a perspective view of components of a kit from which a support assembly can be constructed.

Reference is now made to FIG. 17 in which a kit 100 for constructing the support surface 10 is illustrated in its disassembled configuration. The kit 100 comprises the following components: an air-permeable layer 20; four securable rods 16, 17, 18 and 19; two pairs of opposing frame sections 30, 32, 34 and 36; corner elements 22, 24, 26 and 28; four corner reinforcing elements 42, 44, 46 and 48; transverse cross bars 50 and 52; and legs 91, 92, 93 and 94 which can be optionally connected to the support surface.

The kit 100 can assembled by the user himself at home, or it can be assembled at the selling point. These both options do not require any special appliance, which provided to this kit one of its advantages over known in the art support assemblies with air-permeable layers.

The air-permeable layer 20 has two pairs of opposing layer-edge portions 11, 12, 13 and 14. The air-permeable layer 20 is configured to be stretched at least in a direction D1 between the layer-edge portions 12 and 13, and at least in a direction D2 between the layer-edge-portions 11 and 14. The stretching of the air-permeable layer 20 is configured to provide a tensioned layer which forms a main upper portion of the support surface 10. The support surface is constructed in such a way that enables to stretch and elongate the air-permeable layer 20 while its material is kept in its elastic range. For example, an elongation of the initial distance can be preferably kept in the range of 1-4%, at least in the directions D1 and D2.

The opposing frame sections 30, 32, 34 and 36 are fixedly disposable at a distance therebetween to define and to form together with the corner elements 22, 24, 26 and 28 a rectangular perimeter of a frame 15 (shown in FIG. 20), on which the air-permeable layer 20 can be mounted and tensioned. The frame 15 is configured to provide support to the support surface 10 and to stabilize its structure.

Each of the frame sections 30, 32, 34 and 36 comprises a layer-edge engaging portion 31, 33, 35 and 37, respectively. These layer-edge engaging portion are longitudinal grooves which are formed within their respective frame sections and configured for engaging their respective layer-edge portions for securing them therein by means of pressure fit. The layer-edge engaging portions 31, 33, 35 and 37 are configured to fixedly receive and secure the layer-edge portions 11, 12, 13 and 14 as follows: the layer-edge portion 11 is receivable within the layer-edge engaging portion 35, the layer-edge portion 12 is receivable within the layer-edge engaging portion 31, the layer-edge portion 13 is receivable within the layer-edge engaging portion 33 and the layer-edge portion 14 is receivable within the layer-edge engaging portion 37.

Each of the layer-edge portions is formed as a longitudinal loop which is configured to tightly receive a securable rod therein, via a side opening of the loop, following placement of the layer-edge portion in its corresponding layer-edge engaging portion. By insertion of the securable rods 16, 17, 18, and 19 in the loops of each layer-edge portion 11, 12, 13 and 14, respectively, while the layer-edge portions are received in their corresponding layer-edge engaging portions, the air-permeable layer can be fixedly secured to the frame portions 30, 32, 34 and 36 and thereby to the frame 15. At this stage, the air-permeable layer 20 is still not tensioned.

Each of the frame sections 30, 32, 34 and 36 is integrated with a corresponding tensioning mechanism 60, 62, 64, and 66. Each of the tensioning mechanisms 60, 62, 64, and 66 is configured for moving its corresponding layer-edge engaging portion 31, 33, 35 and 37 respectively together with the layer-edge portions 12, 13, 11 and 14 mounted thereto. During the assembly of the support surface 10, each layer-edge engaging portion is configured to pivotally move relative to an opposing frame section in order to at least partially tension the air-permeable layer 20 between the frame section of the layer-edge engaging portion and the opposing frame section.

The air-permeable layer 20 which is configured to be suspended and stretched or tensioned on the frame 15 of the support surface can have the same characteristics of the air-permeable layer described above. For example, one suitable air-permeable layer 20 is a screen printing mesh made of polyester. Such an air-permeable layer has a tensile strength of greater than 1000 N that can withstand a concentrated load of greater than 400 N without being punctured and is fatigue resistant during 2000 pressure applications of 10 N/100 cm2. An exemplary air-permeable layer is the PET 1000 15/40-200 W PW screenprinting mesh manufactured by Sefar AG, Thal, Switzerland made of polyester and having a warp and weft mesh count of greater than 14.5/cm and a fabric thickness of less than 375 microns.

Figure 18:
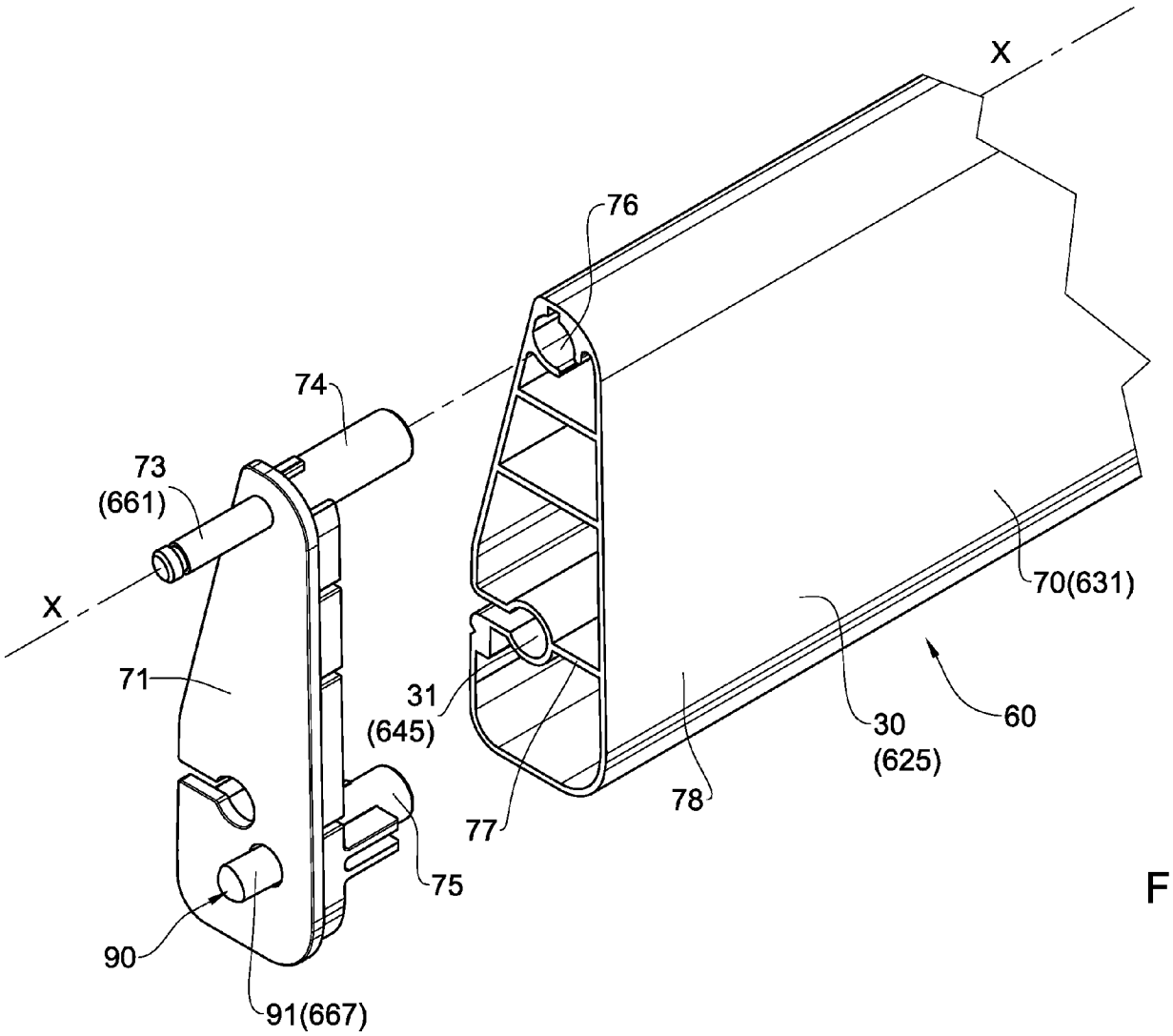
FIG. 18 illustrates a perspective view of a frame section from which a frame of support assembly can be assembled.
Figure 19A:
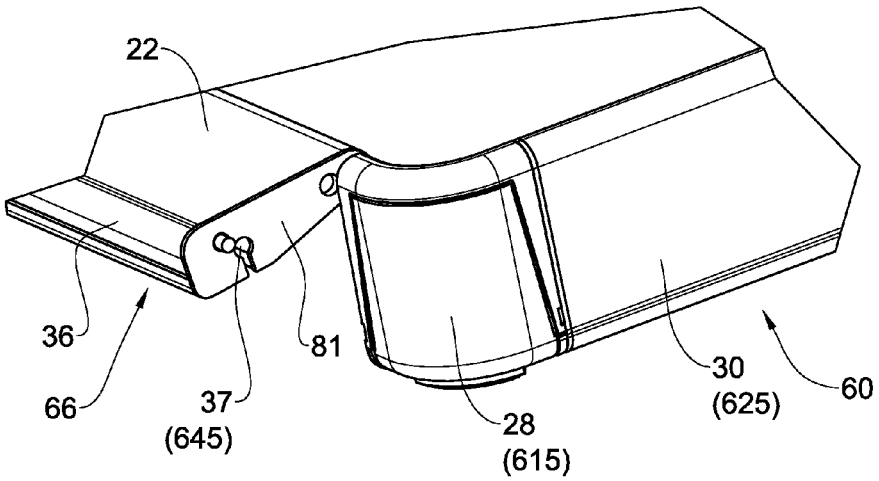
FIGS. 19A-B illustrate a perspective view of two frame sections interconnected therebetween by a corner element, and a separate corner element, respectively.

Reference is now made to FIGS. 18 and 19*a* in order to explain in a detailed manner the structure and the function of the tensioning mechanisms 60 and 66 and their corresponding frame sections 30 and 36. It should be noted this explanation is relevant for all the tensioning mechanisms and frame sections of the kit 100.

In FIG. 18 illustrated a portion of the frame section 30 with its corresponding tensioning mechanism 60. The frame section 30 and the tensioning mechanism 60 share common elements such as a wall 70, an end element 71, and an additional end element (not shown) disposed at the other end of the frame section 30. The end element 71 is connectable to a corresponding corner element 28 so as to fix the frame section 30 to the corner element 28. According to another example, the end element 71 can be integrated with a frame section body 78, and not provided as a separate element as in the present example. The end element 71 which is also part of the tensioning mechanism 60, comprises a pivot element 73 having pivoting axis X about which the frame section 30 is configured for pivoting together with the layer-edge engaging portion 31 and the corresponding layer-edge portion 12 when connected thereto. The pivot element 73 is connectable to a corresponding pivot receiving portion (not shown) of a corner element 28, so as to rotate therein with respect to the corner. The end element 71 additionally comprises a first fixing element 74 and a second fixing element 75. In order to fixedly dispose the end element 71 within the frame section body 78, the first fixing element 74 is fixedly receivable within a first recess 76, and the second fixing element 75 is fixedly receivable in proximity to a supporting part 77.

FIG. 19A illustrates the pivoting operation of the frame sections 30 and 36 with their respective tensioning mechanisms 60 and 66, with respect to the corner element 28 to which they are pivotally mounted, without an air-permeable layer connected thereto. This figure is presented only to illustrate the pivoting operation of these frame sections with respect to the corner element 28. The frame section 36 is disposed with its tensioning mechanism 66 in a pre-tensioned position in which an end element 81 is mis-aligned with the corner element 28, and the frame section 30 is disposed with its tensioning mechanism 60 in a tensioned position in which the end element is aligned with the corner element 28. When the layer-edge portion 14 is received within the layer-edge engaging portion 37, the air-permeable layer is at least partially tensioned in this tensioned position by the tensioning mechanism 66. In order to bring the frame section 36 from its pre-tensioned position to its tensioned position, a rotational force has to be applied on a wall 82 of the frame section 36. This rotational force may be applied by the user/constructor himself, without the need of a specific appliance. When the frame section 36 is brought to the tensioned position of its tensioning mechanism 66, its layer-edge engaging portion 37 is spaced from the opposition frame section 34 to a distance shorter than that in the pre-tensioned position.

In order to fix a frame section and its tensioning mechanism in its tension position to a respective corner element, each frame section comprises a fixing mechanism at each end element thereof. FIG. 18 illustrates a fixing mechanism 90 having a pin 91 which is mounted to the end element 71 via a spring (not shown) disposed within the second fixing element 75. When brought in proximity to the corner element 28, the pin 91 can be pressed by the user into the interior of the second fixing element 75, and in the tension position, the spring will push the pin 91 back to its initial position while fixing it in a respective pin-groove (not shown) formed within the corner element 28, and thereby prevent the tensioning mechanism 66 from leaving its tensioned position. As corner element 28, each of the corner elements of kit 100 are provided with two pin-grooves disposed at different sides of the corner element, for fixing therein respective pins of its frame sections.

Figure 19B:
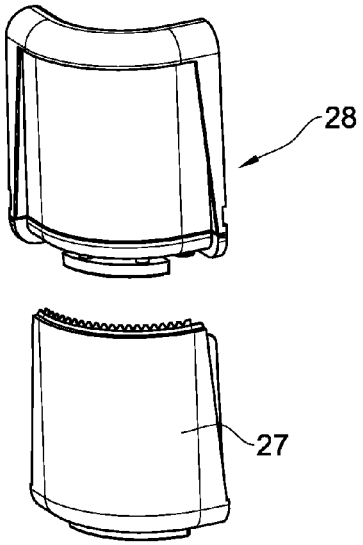

FIG. 19B illustrates for example a corner element 28 with a cover element 27 removed therefrom. The cover element 27 is configured to be fix therein layer-corner portion 8 (shown in FIG. 17) following the mounting of the air-permeable layer 20 on the frame 15. This operation can stabilize the corners of the air-permeable layer 20, and thereby improve the mounting of the air-permeable layer 20 to the frame 15. The rest of the corner elements of the kit 100 also have corresponding cover elements configured for the same purpose.

Reference is now made to FIGS. 20, 21 and 22A-B which schematically illustrate steps for constructing the support surface 10 from the components of the kit 100. This construction can be fully performed by a user without using any special appliance.

Figure 20:
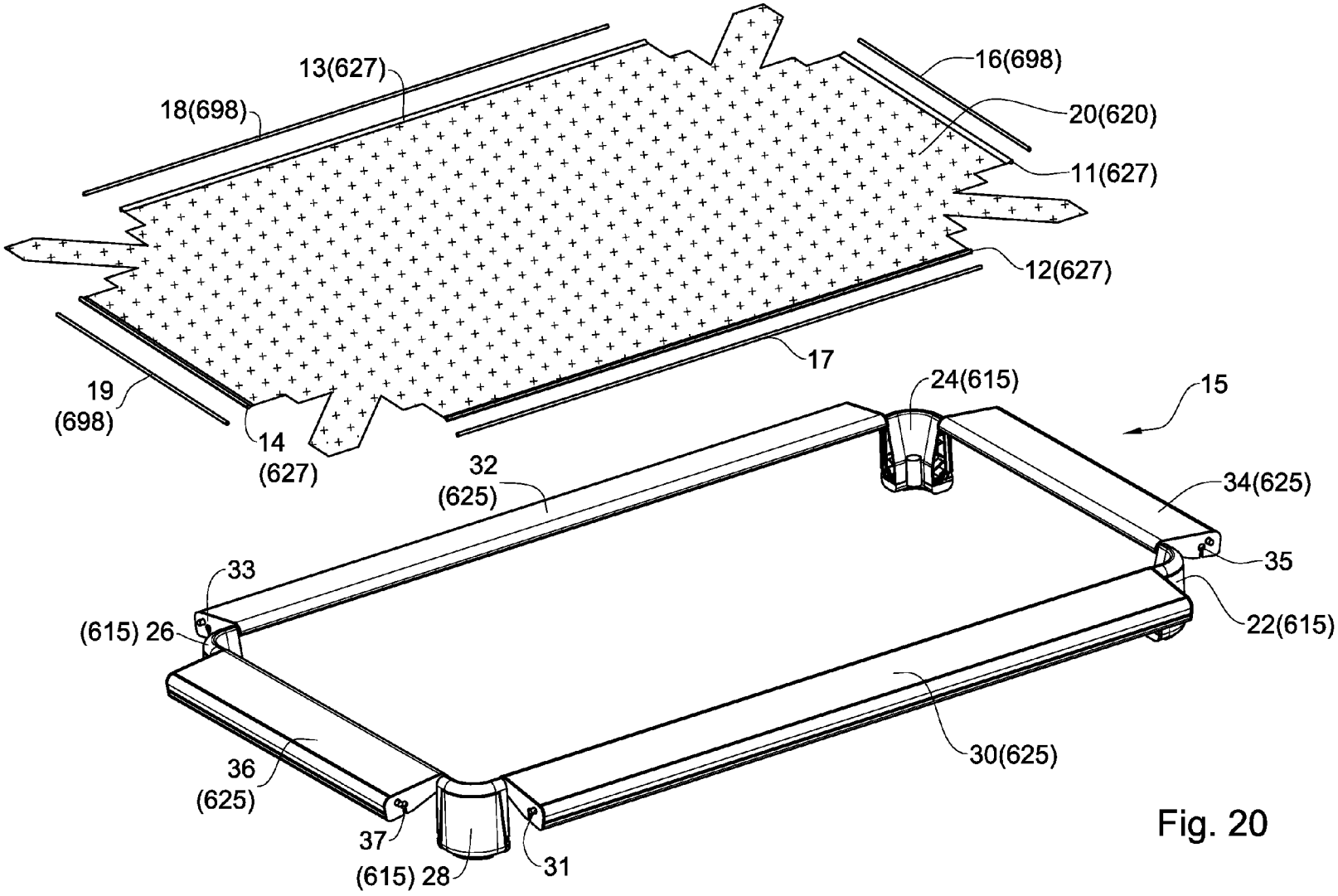
FIG. 20 illustrates a perspective view of a support assembly before being assembled.

As shown in FIG. 20, the frame sections 30, 32, 34 and 36 are pivotally coupled to the corner elements 22, 24, 26 and 28, so as to form the frame 15. Following the construction of the frame 15, while at least part of the frame sections and their tensioning mechanisms are in their pre-tensioned position, the air-permeable layer 20 can be connected to this frame by fixedly engaging the layer-edge engaging portions 11, 12, 13 and 14 with their corresponding layer-edge portions 31, 33, 35 and 37. Following this engagement, the air-permeable layer can be tensioned on the frame 15 by the tensioning mechanisms of the frame sections.

Figure 21:
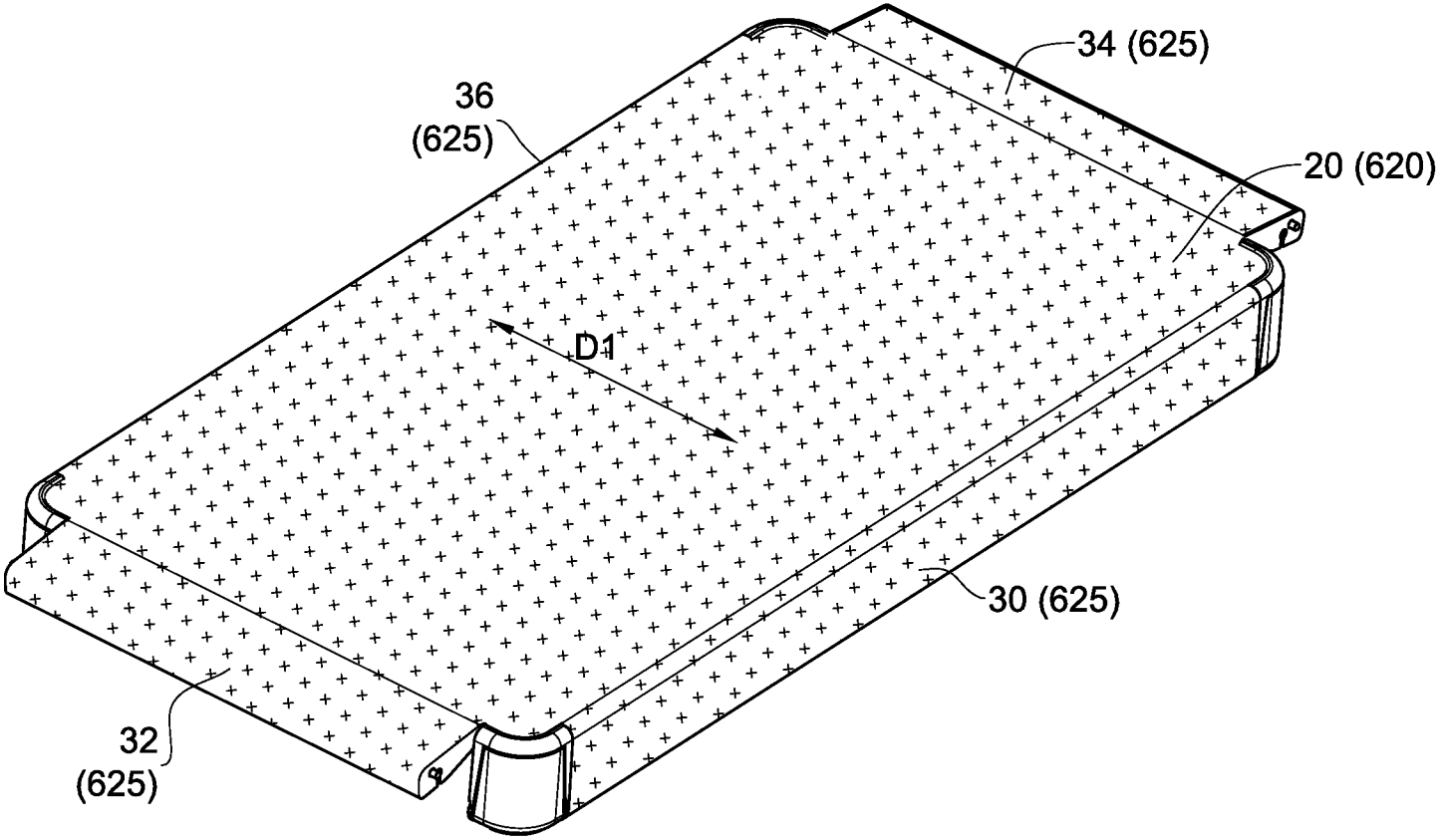
FIG. 21 illustrates a perspective view of a support assembly with an air-permeable layer which is not fully tensioned.

As shown in FIG. 21, the air permeable layer 20 is tensioned by the tensioning mechanisms 60 and 66 at least in the direction D1. In this figure, the tensioning mechanisms 60 and 66 and the frame sections 30 and 36 are in their tensioned position, and the tensioning mechanisms 62 and 64 and the frame sections 32 and 34 are in their pre-tensioned position. In order to bring the tensioning mechanisms 60 and 66 to their tensioned position, the layer-edge engaging portions 31 and 33 were moved together with the layer-edge portions 12 and 13 of the air-permeable layer 20 so as to align the frame sections 30 and 32 with their corresponding corner elements, and to fix the corresponding pins of the fixing mechanisms within these corner elements.

Figure 22A:
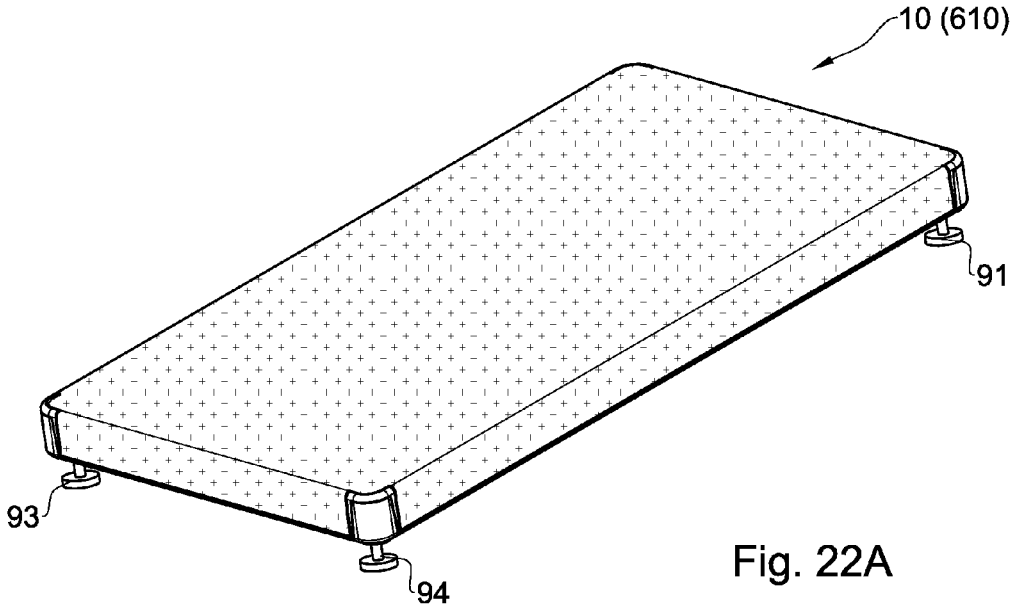
FIG. 22A illustrate a perspective view of an assembled support assembly.
Figure 22B:
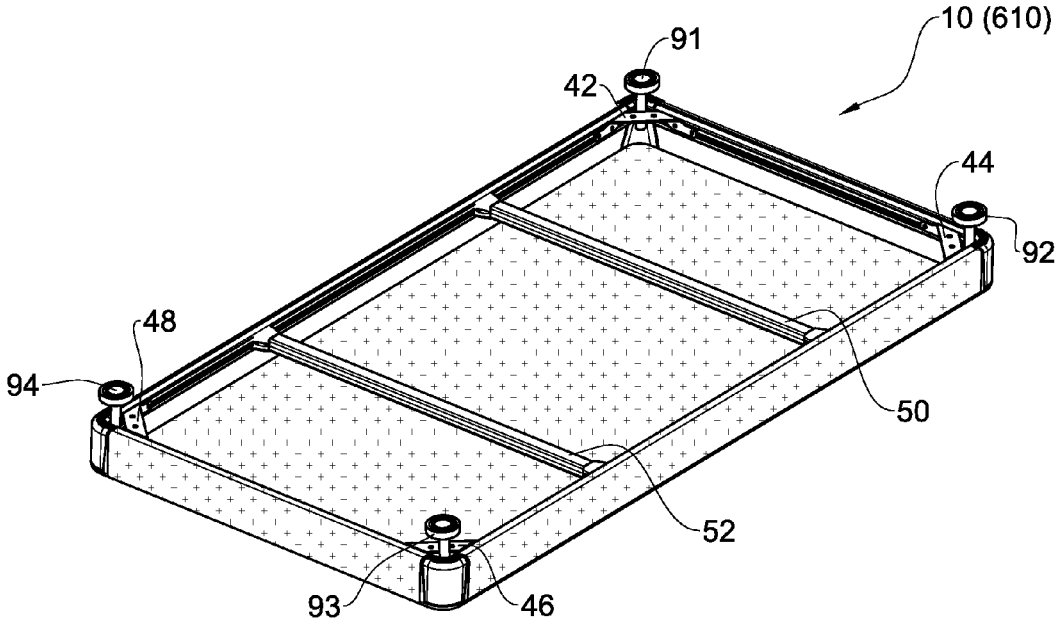
FIG. 22B illustrates a perspective view of a support assembly being upside down.

As shown in FIGS. 22A-B, the air-permeable layer 20 is fully tensioned on the frame 15, and the support assembly 10 is ready for use. In order to bring the support 10 to this final configuration, the frame sections 32 and 34 of FIG. 21 are brought to their tensioned position, and the stabilizing members of the kit 100 are fixed between the frame elements of the frame 15. In FIG. 22B it is shown how that the corner reinforcing elements 42, 44, 46 and 48 are fixedly mounted between each two neighboring frame sections, and how the transverse cross bars 50 and 52 are fixedly mounted between the frame sections 30 and 32.

Figure 23:
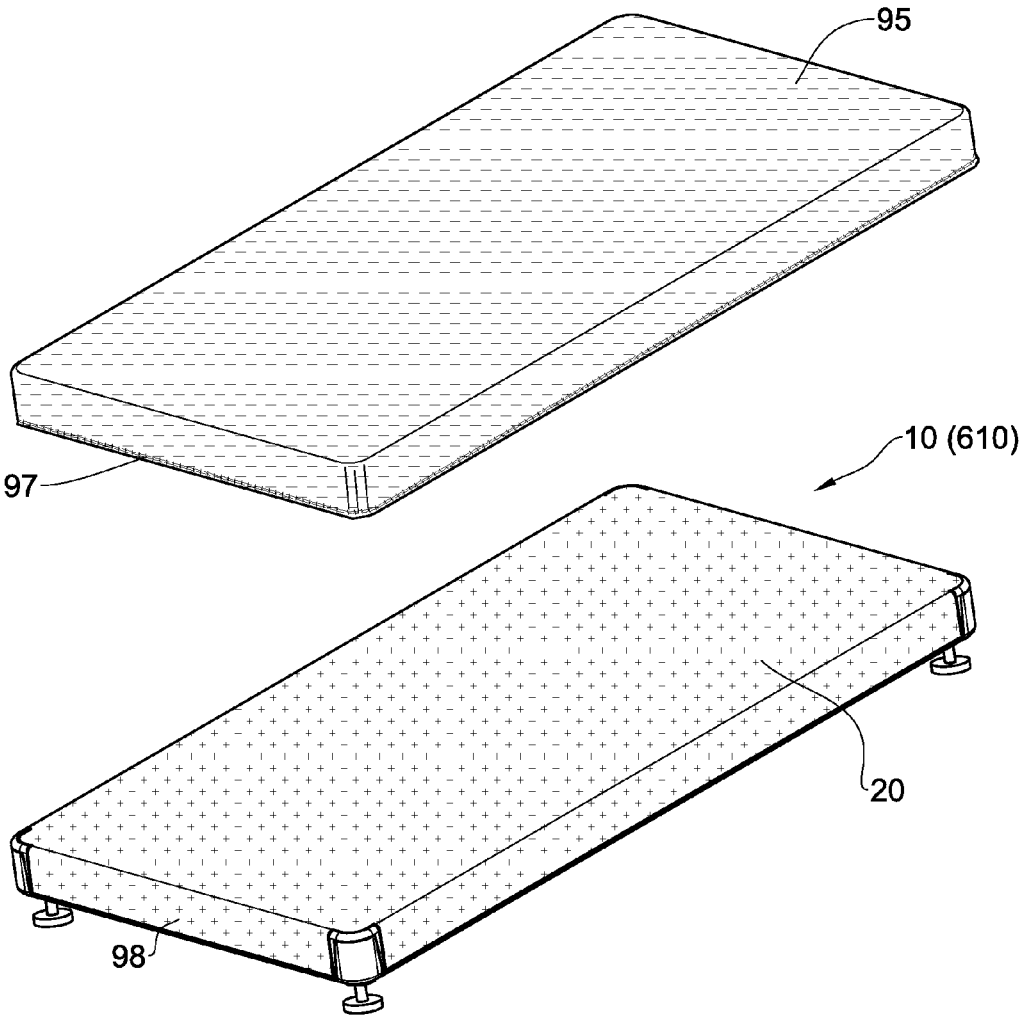
FIG. 23 illustrates a perspective view of a supplementary layer to be used with the support surface of the presently disclosed subject matter.

Reference is now made to FIG. 23 which schematically illustrates a supplementary layer 95 which can be used with the support surface 10. The supplementary layer 95 is configured to be mounted on the air-permeable layer 20 of the support surface 10 and to cover the upper portion thereof. The supplementary layer 95 has ribs 97 which are configured to be mounted around the peripheral portion 98 of the support surface 20 for connecting to the support surface 10. The air-permeable layer 20 constitutes a main mattress layer having a first air-permeable mesh fiber material having a first space-to-fiber ratio, and the supplementary layer is made of second air-permeable mesh fiber material which is softer than the first material and which has a second fiber to area ratio greater than the first space-to-fiber ratio. For example, if the first fiber to area ratio is between 40% and 60%, the second fiber to area ratio is 70% to 90%. The supplementary layer can be made of polyester and can have a width of between 5 mm and 7 mm.

EXAMPLES

Several experiments were conducted using the support surface assembly of the present invention to determine the effectiveness of the invention with regard to the health benefits as described herein above.

Example 1

This experiment was performed to determine the amount of dust mites that the support surface assembly of the present invention retains in comparison to a conventional mattress.

*Dermatophagoides farinae* (house dust mites) were cultured in a laboratory using a mixture of horse dander/medical yeast (2:1) at a temperature of 25±1° C. 75±5 relative humidity.

Three support surface assemblies of the present invention, each with a netting of 200 micron (20×20×6×2.8 cm), with 15 strings per cm and 48% open space, were tested and compared with a control (conventional) mattress, the core of which was a polymeric sponge covered with a tissue composed of 50% cotton and 50% polyester (22×22×8 cm), for the survival of mites under optimal environmental conditions. 0.01 mg of mites taken directly from the colony (without medium) (ca. 250-300 mites) and 40 mg of medium were evenly distributed over the entire surface of the support surface assemblies and mattress. Thereafter, the support surface assembly and mattresses were placed in an incubator (24° C. and 70-80% relative humidity). The viability of the mites was examined under a stereo-microscope after 2, 4 and 7 days. On day 7, the support surface assemblies were rinsed thoroughly with distilled water, and thereafter were examined under the stereo-microscope for any remaining mites. Mites were removed from the control mattress surface by shaking it over a container with water. Adhesive bands were glued on the surface of each mattress and the few remaining mites were collected and counted as well. The water with mites and medium from all four support surface assemblies and mattresses was filtered separately through several white filter papers (Schleicher & Schuell, 604, 7 cm diameter), and the number of live mites was counted under a stereo-microscope (5×).

Figures 24, 25:
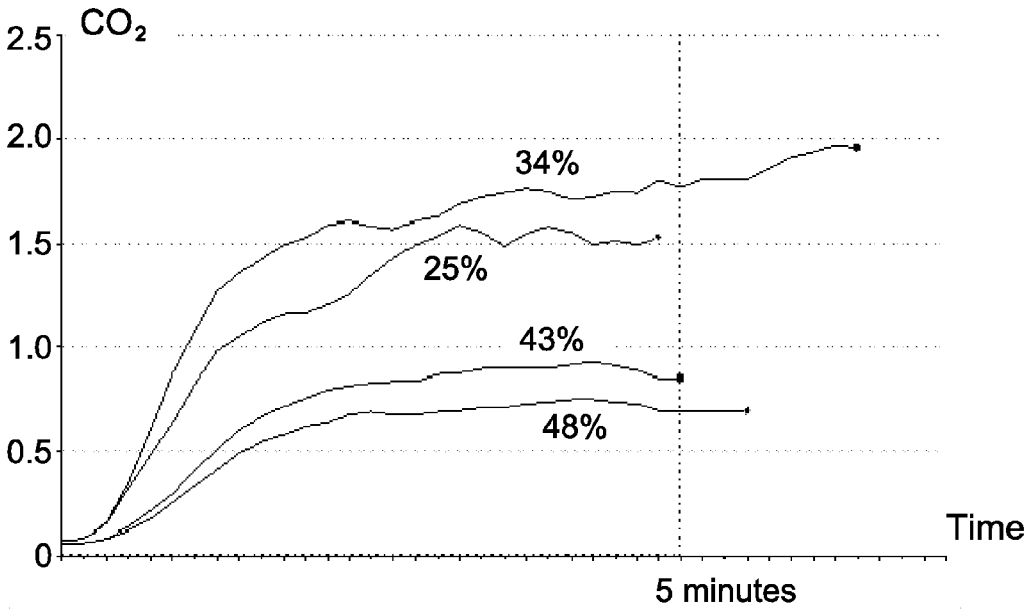
FIG. 24 presents CO2 accumulation (%) in head box as function of elapsed time (minutes) with fiber to area ratio as a parameter, for 25%, 34%, 43% and 48% parameter values.
FIG. 25 illustrates the results of the first example, for determining the ability of the invention to prevent dust mites from accumulating on the support surface, in Table 1.

The results of this experiment, showing the mite survival during the two days of experiment are displayed in Table 1, in FIG. 25. After days 2 and 4, very few (+) or few + mites were detected on the support surface assemblies (I, J, K), and a lot ++ of mites were detected on the control mattress (C). After day 7, all three support surface assemblies had very few mites, with an average of 26.3 mites between them. The control mattress contained a lot of mites, estimated at 490.

The few mites seen on the support surface assemblies were mainly concentrated at the edges of the mattress where the food and mites could survive between the wood and netting. The distance between fibers was large enough to prevent mites and medium from remaining on the surface. On the control mattress, mites were apparently behaving normally (laying eggs, copulating, eating). 30 times fewer mites could be found on the support surface assembly of the present invention than on the control mattress after 2 days of experimentation.

Example 2

An additional experiment has compared ventilation properties of nets having different space to fiber ratios. This experiment was done in a hospital pulmonary laboratory, and an AirNettress® mattress of Lizron, The Child Development Company, Pardes-Hana, Israel, was used. The mattress is made of a polyester net (Sefar AG Filtration Solutions, Heiden, Switzerland) which is stretched over a wooden or aluminum frame. The net was made of 200 micron diameter fibers at a density of 15 fibers/cm, which attains a space to fiber ratio of approximately 1:1 (48%-fiber to area ratio), as well as nets having lower fiber to area ratios, 43%, 34% and 25%. A head box was placed with its open face on the mattress and connected with tubing to a gas reservoir filled with 7% CO2. The 7% CO2 mixture flowed into the head box at a rate of 1.5 Liter/minute (L/m). The rate of CO2 accumulation in the head box was measured at 10 second intervals for at least 5 minutes. The nets with fiber to area ratios of 43% and 48% exhibited significantly lower tendencies towards CO2 accumulation (under 1% CO2) than the nets with fiber to area ratios of 34% and 25%, (over 1.5% CO2), as shown in FIG. 24.

To conclude, significant rebreathing of CO2 may be prevented by use of a netted surface with a fiber to area ratio of above 40%. Note that CO2 levels below 1% are considered safe environmental conditions according to NIOSH guidelines, DHHS Publication No. 76-194, august 1976.

Example 3

The Standards Institution of Israel, Tel Aviv, conducted several fatigue tests to determine various parameters of the air-permeable layer. The sample that was tested had a thickness of 200 microns, a warp and weft mesh count of 15.0/cm. After 500 pressing operations, the sample was shown not to sag at all. After 1000 pressing operations, the sample was shown to slightly sag. After 2000 pressing operations, the sample was shown to sag 2 mm at the point of impact. In all these pressing operations, a load of 1 kg was loaded on a surface of 10 cm×10 cm with a speed of 50 mm/sec, The tensile strength of the sample was tested. The sample was shown to have a lengthwise tensile strength of 1374 N, a widthwise tensile strength of 1031 N, a lengthwise elongation of 21%, and a widthwise elongation of 34%.

Example 4

The laboratory division of Sefar AG, Thal, Switzerland, conducted an elasticity test on a sample of PET 1000 15-200 W PW screenprinting mesh. The sample that was tested had a thickness of 200 microns, a warp and weft mesh count of 15.0/cm.

The sample was overnight and then during the daytime was not tensioned. The tension of the sample was measured at night and during the daytime. The test was repeated three times. Here are the results:

TABLE III

| Test Period | Elongation Warp (%) | Elongation Weft (%) |
|---|---|---|
| Monday evening, tensioned | 1.0 | 0.5 |
| Tuesday morning, non-tensioned | 0 | 0 |
| Tuesday evening, tensioned | 1.0 | 0.5 |

TABLE III-continued

| Test Period | Elongation Warp (%) | Elongation Weft (%) |
|---|---|---|
| Wednesday morning, non-tensioned | 0 | 0 |
| Wednesday evening, tensioned | 1.1 | 0.5 |
| Thursday morning, non-tensioned | 0.3 | 0.2 |
| Thursday evening, tensioned | 1.3 | 0.6 |
| Friday morning, non-tensioned | 0.5 | 0.2 |

Example 5

The Japan Food Hygiene Association, Tokyo, conduction various tests on a white UX-SCREEN. The sample was shown to pass the material test with respect to cadmium and lead, the dissolution test with respect to heavy metals, consumption of potassium permanganate, antimony and germanium, and the residue on evaporation after dissolution test with the solvents of n-heptane, 20% ethanol, water, and 4% acetic acid.

CONCLUSION

The experimental results show that the present invention provides a safe support surface assembly for sleeping thereon, particularly for infants and those suffering from allergies, and enables effortless breathing through it.

While some embodiments of the invention have been described by way of illustration, it will be apparent that the invention can be carried into practice with many modifications, variations and adaptations, and with the use of numerous equivalents or alternative solutions that are within the scope of persons skilled in the art, without departing from the spirit of the invention or exceeding the scope of the claims.

The invention claimed is:

1. A kit for constructing a support surface for a sleeping person, said kit comprising:

an air-permeable layer having at least one pair of opposing layer-edge portions stretchable at least in the direction between said layer-edge portions to form said support surface;

at least one pair of substantially parallel opposing frame sections fixedly disposable at a distance therebetween for forming at least a portion of a frame supporting said support surface, at least a first frame section of said frame sections comprising a layer-edge engaging portion configured for fixedly engaging a corresponding layer-edge portion; and at least one pair of opposing corner elements;

wherein said first frame section is pivotally mountable between said corner elements for pivoting at least from a pre-tensioned position in which said layer-edge engaging portion and said corresponding layer-edge portion are spaced from the opposition frame section to a first distance, to a tensioned position in which said layer-edge engaging portion and said corresponding layer-edge portion are spaced from said opposition frame section to a second distance which is shorter than said first distance, so as to at least partially tension said air-permeable layer between said frame sections.

2. The kit according to claim 1, wherein said air-permeable layer is a screen printing mesh characterized by a fiber to area ratio of between 40% and 60% or by a mesh count of greater than 14.5/cm.

3. The kit according to claim 1, wherein said air-permeable layer is characterized by a tensile strength greater than 1000 N.

4. The kit according to claim 1, wherein said air-permeable layer is characterized by an ability to withstand fatigue tests of 500 pressing operations in which a load of 1 kg is loaded on a surface of 10 cm×10 cm with a speed of 50 mm/sec, without sagging and 2000 pressing operations in which the same load, surface and speed are applied, resulting in sagging of 2 mm at the point of impact.

5. The kit according to claim 1, wherein said air-permeable layer exhibits a long and a short dimension, said air-permeable layer is stretched so that in the long dimension said air-permeable layer is under a greater tension than in the short dimension.

6. The kit according to according to claim 1, wherein said at least one pair of substantially parallel opposing frame sections includes two pairs of substantially parallel opposing frame sections forming a rectangular perimeter of said frame, said at least one pair of opposing corner elements is two pairs of opposing corner elements, and said at least one pair of opposing layer-edge portions are two pairs of opposing layer-edge portions, each of said frame sections comprises said layer-edge engaging portion configured for fixedly engaging a corresponding layer-edge portion and pivotally moved at least from a tension position thereof to a tensioned position thereof so as to at least partially tension said air-permeable layer.

7. The kit according to claim 1, wherein said layer-edge engaging portion is a longitudinal groove formed in said frame section configured for engaging a corresponding one of the layer-edge portions and for securing corresponding one of the layer-edge portions therein by a pressure fit.

8. A support surface for a sleeping person, said support surface comprising:

an air-permeable layer having at least one pair of opposing layer-edge portions stretched at least in the direction between said layer-edge portions to form said support surface;

at least one pair of substantially parallel opposing frame sections fixedly disposed at a distance therebetween and forming at least a portion of a frame supporting said support surface, at least a first frame section of said frame sections comprising a layer-edge engaging portion fixedly engaging a corresponding layer-edge portion; and at least one pair of opposing corner elements;

wherein said first frame section is pivotally mounted between said corner elements for pivoting at least from a pre-tensioned position in which said layer-edge engaging portion and said corresponding layer-edge portion are spaced from the opposition frame section to a first distance, to a tensioned position in which said layer-edge engaging portion and said corresponding layer-edge portion are spaced from said opposition frame section to a second distance which is shorter than said first distance, so as to at least partially tension said air-permeable layer between said frame sections.

9. The support surface according to claim 8, wherein said air-permeable layer is a screen printing mesh characterized by a fiber to area ratio of between 40% and 60%, or by a mesh count of greater than 14.5/cm.

10. The support surface according to claim 8, wherein said air-permeable layer is characterized by a tensile strength greater than 1000 N.

11. The support surface according to claim 8, wherein said air-permeable layer is characterized by an ability to withstand fatigue tests of 500 pressing operations in which load of 1 kg is loaded on a surface of 10 cm×10 cm with a speed of 50 mm/sec, without sagging and 2000 pressing operations in which the same load, surface and speed are applied, resulting in sagging of 2 mm at the point of impact.

12. The support surface according to claim 8, wherein said air-permeable layer is having a long and a short dimension, said air-permeable layer stretched so that in the long dimension said air-permeable layer is under a greater tension than in the short dimension.

13. A method for constructing a support surface for a sleeping person from components of a kit comprising: an air-permeable layer having at least one pair of opposing layer-edge portions stretchable at least in the direction between said layer-edge portions to form said support surface; at least one pair of substantially parallel opposing frame sections fixedly disposable at a distance therebetween for forming at least a portion of a frame supporting said support surface, at least a first frame section of said frame sections comprising a layer-edge engaging portion; and at least one pair of opposing corner elements; said method comprising:

fixedly engaging said layer-edge engaging portion with a corresponding layer-edge portion of said layer-edge portions; and pivoting said first frame section from a pre-tensioned position in which said layer-edge engaging portion and said corresponding layer-edge portion are spaced from the opposition frame section to a first distance, to a tensioned position in which said layer-edge engaging portion and said corresponding layer-edge portion are spaced from said opposition frame section to a second distance which is shorter than said first distance, thereby at least partially tensioning said air-permeable layer between said frame sections.

* * * * *